US008203582B2

(12) United States Patent
Elliott et al.

(10) Patent No.: US 8,203,582 B2
(45) Date of Patent: Jun. 19, 2012

(54) SUBPIXEL RENDERING WITH COLOR COORDINATES' WEIGHTS DEPENDING ON TESTS PERFORMED ON PIXELS

(75) Inventors: Candice Hellen Brown Elliott, Santa Rosa, CA (US); Michael Francis Higgins, Duncan's Mills, CA (US)

(73) Assignee: Samsung Electronics Co., Ltd. (KR)

( * ) Notice: Subject to any disclaimer, the term of this patent is extended or adjusted under 35 U.S.C. 154(b) by 294 days.

(21) Appl. No.: 12/546,324

(22) Filed: Aug. 24, 2009

(65) Prior Publication Data

US 2011/0043552 A1 Feb. 24, 2011

(51) Int. Cl.
*G09G 5/02* (2006.01)

(52) U.S. Cl. ..... 345/694; 345/696; 345/690; 345/589

(58) Field of Classification Search ..... None
See application file for complete search history.

(56) References Cited

U.S. PATENT DOCUMENTS

| | | | | |
|---|---|---|---|---|
| 7,222,306 | B2 * | 5/2007 | Kaasila et al. | 715/801 |
| 7,248,268 | B2 | 7/2007 | Brown Elliott et al. | |
| 7,864,194 | B2 * | 1/2011 | Credelle et al. | 345/613 |
| 2003/0034992 | A1 | 2/2003 | Brown Elliott et al. | |
| 2003/0085906 | A1 | 5/2003 | Elliott et al. | |
| 2004/0051724 | A1 | 3/2004 | Elliott et al. | |
| 2004/0196297 | A1 * | 10/2004 | Elliott et al. | 345/613 |
| 2005/0104908 | A1 | 5/2005 | Brown Elliott | |
| 2005/0225563 | A1 | 10/2005 | Brown Elliott et al. | |
| 2005/0225574 | A1 | 10/2005 | Brown Elliott et al. | |
| 2006/0244686 | A1 | 11/2006 | Higgins et al. | |
| 2007/0279372 | A1 | 12/2007 | Brown Elliott et al. | |
| 2008/0049048 | A1 | 2/2008 | Credelle et al. | |
| 2009/0102783 | A1 | 4/2009 | Hwang et al. | |

FOREIGN PATENT DOCUMENTS

| | | | |
|---|---|---|---|
| WO | WO 2006/127555 | A2 | 11/2006 |
| WO | WO 2007/047537 | A2 | 4/2007 |

OTHER PUBLICATIONS

U.S. Appl. No. 12/546,410, filed Aug. 24, 2009, 68 pages.
U.S. Appl. No. 12/546,348, filed Aug. 24, 2009, 72 pages.

* cited by examiner

*Primary Examiner* — Muhammad N Edun
(74) *Attorney, Agent, or Firm* — Innovation Counsel LLP

(57) ABSTRACT

If a pixel (106) of an image is displayed in a subpixel area (124) which does not contain a primary color needed to display the pixel, and saturated colors are present in or adjacent to the subpixel area, then some of the pixel's luminance is shifted (850) to adjacent subpixel areas on one but not both sides of the pixel to avoid blurring the pixel. Other embodiments are also provided.

31 Claims, 8 Drawing Sheets

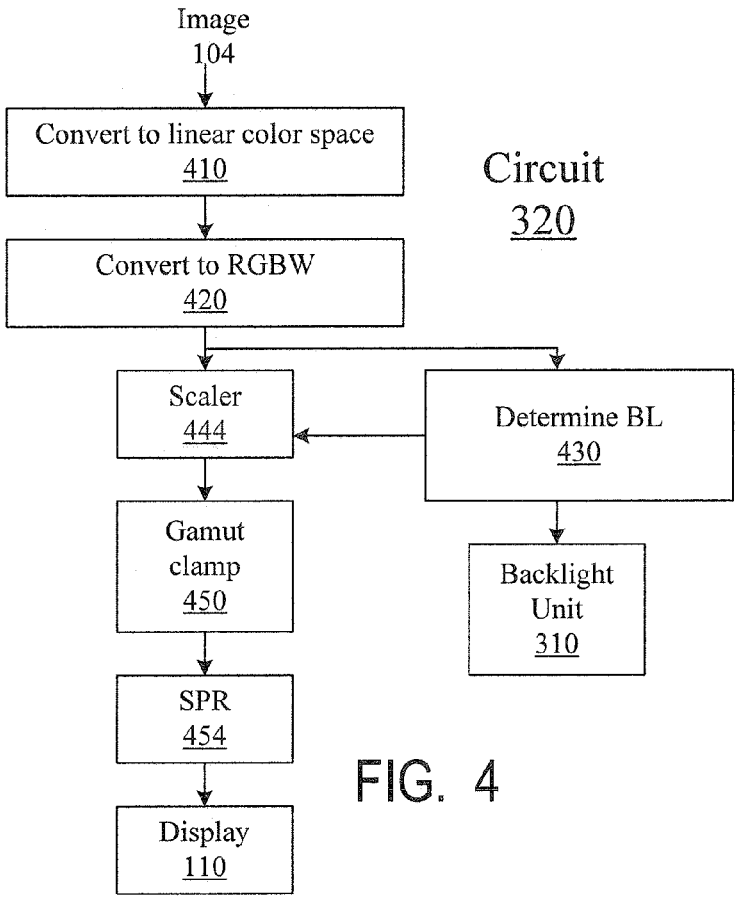
FIG. 4
FIG. 5
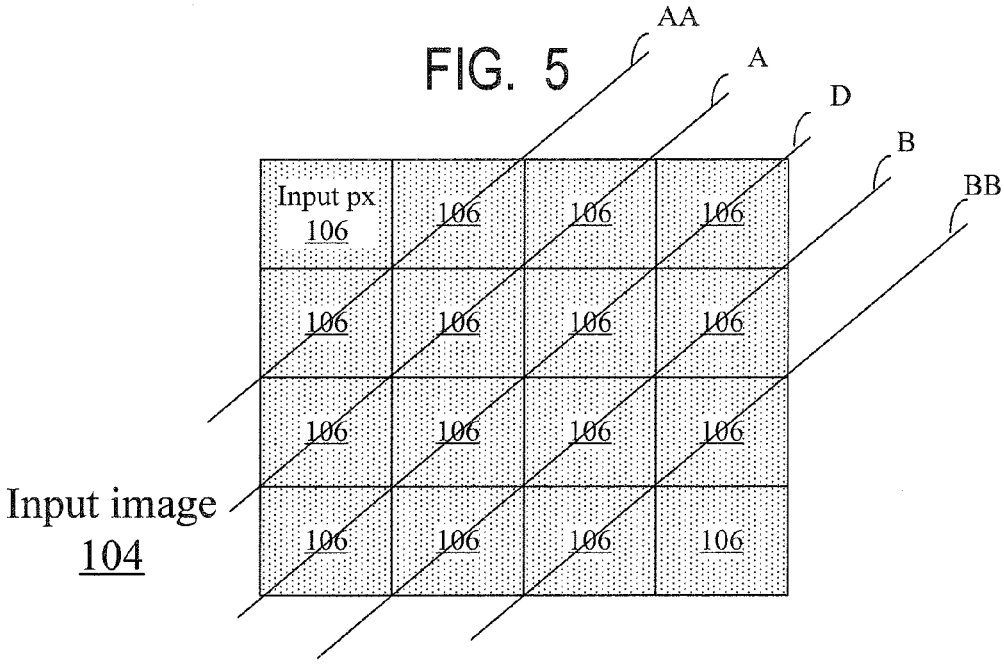

SUBPIXEL RENDERING WITH COLOR COORDINATES' WEIGHTS DEPENDING ON TESTS PERFORMED ON PIXELS

BACKGROUND OF THE INVENTION

The present invention relates to subpixel rendering and gamut mapping in display devices.

Novel sub-pixel arrangements are disclosed for improving the cost/performance curves for image display devices in the following commonly owned United States Patents and Patent Applications including: (1) U.S. Pat. No. 6,903,754 ("the '754 Patent") entitled "ARRANGEMENT OF COLOR PIXELS FOR FULL COLOR IMAGING DEVICES WITH SIMPLIFIED ADDRESSING;" (2) United States Patent Publication No. 2003/0128225 ("the '225 application") having application Ser. No. 10/278,353 and entitled "IMPROVEMENTS TO COLOR FLAT PANEL DISPLAY SUB-PIXEL ARRANGEMENTS AND LAYOUTS FOR SUB-PIXEL RENDERING WITH INCREASED MODULATION TRANSFER FUNCTION RESPONSE," filed Oct. 22, 2002; (3) United States Patent Publication No. 2003/0128179 ("the '179 application") having application Ser. No. 10/278,352 and entitled "IMPROVEMENTS TO COLOR FLAT PANEL DISPLAY SUB-PIXEL ARRANGEMENTS AND LAYOUTS FOR SUB-PIXEL RENDERING WITH SPLIT BLUE SUB-PIXELS," filed Oct. 22, 2002; (4) United States Patent Publication No. 2004/0051724 ("the '724 application") having application Ser. No. 10/243,094 and entitled "IMPROVED FOUR COLOR ARRANGEMENTS AND EMITTERS FOR SUB-PIXEL RENDERING," filed Sep. 13, 2002; (5) United States Patent Publication No. 2003/0117423 ("the '423 application") having application Ser. No. 10/278,328 and entitled "IMPROVEMENTS TO COLOR FLAT PANEL DISPLAY SUB-PIXEL ARRANGEMENTS AND LAYOUTS WITH REDUCED BLUE LUMINANCE WELL VISIBILITY," filed Oct. 22, 2002; (6) United States Patent Publication No. 2003/0090581 ("the '581 application") having application Ser. No. 10/278,393 and entitled "COLOR DISPLAY HAVING HORIZONTAL SUB-PIXEL ARRANGEMENTS AND LAYOUTS," filed Oct. 22, 2002; and (7) United States Patent Publication No. 2004/0080479 ("the '479 application") having application Ser. No. 10/347,001 and entitled "IMPROVED SUB-PIXEL ARRANGEMENTS FOR STRIPED DISPLAYS AND METHODS AND SYSTEMS FOR SUB-PIXEL RENDERING SAME," filed Jan. 16, 2003. Each of the aforementioned '225, '179, '724, '423, '581, and '479 published applications and U.S. Pat. No. 6,903,754 are hereby incorporated by reference herein in its entirety.

For certain subpixel repeating groups having an even number of subpixels in a horizontal direction, systems and techniques to affect improvements, e.g. polarity inversion schemes and other improvements, are disclosed in the following commonly owned United States patent documents: (1) United States Patent Publication No. 2004/0246280 ("the '280 application") having application Ser. No. 10/456,839 and entitled "IMAGE DEGRADATION CORRECTION IN NOVEL LIQUID CRYSTAL DISPLAYS"; (2) United States Patent Publication No. 2004/0246213 ("the '213 application") (U.S. patent application Ser. No. 10/455,925) entitled "DISPLAY PANEL HAVING CROSSOVER CONNECTIONS EFFECTING DOT INVERSION"; (3) United States Patent Publication No. 2004/0246381 ("the '381 application") having application Ser. No. 10/455,931 and entitled "SYSTEM AND METHOD OF PERFORMING DOT INVERSION WITH STANDARD DRIVERS AND BACKPLANE ON NOVEL DISPLAY PANEL LAYOUTS"; (4) United States Patent Publication No. 2004/0246278 ("the '278 application") having application Ser. No. 10/455,927 and entitled "SYSTEM AND METHOD FOR COMPENSATING FOR VISUAL EFFECTS UPON PANELS HAVING FIXED PATTERN NOISE WITH REDUCED QUANTIZATION ERROR"; (5) United States Patent Publication No. 2004/0246279 ("the '279 application") having application Ser. No. 10/456,806 entitled "DOT INVERSION ON NOVEL DISPLAY PANEL LAYOUTS WITH EXTRA DRIVERS"; (6) United States Patent Publication No. 2004/0246404 ("the '404 application") having application Ser. No. 10/456,838 and entitled "LIQUID CRYSTAL DISPLAY BACKPLANE LAYOUTS AND ADDRESSING FOR NON-STANDARD SUBPIXEL ARRANGEMENTS"; (7) United States Patent Publication No. 2005/0083277 ("the '277 application") having application Ser. No. 10/696,236 entitled "IMAGE DEGRADATION CORRECTION IN NOVEL LIQUID CRYSTAL DISPLAYS WITH SPLIT BLUE SUBPIXELS", filed Oct. 28, 2003; and (8) United States Patent Publication No. 2005/0212741 ("the '741 application") having application Ser. No. 10/807,604 and entitled "IMPROVED TRANSISTOR BACKPLANES FOR LIQUID CRYSTAL DISPLAYS COMPRISING DIFFERENT SIZED SUBPIXELS", filed Mar. 23, 2004. Each of the aforementioned '280, '213, '381, '278, '404, '277 and '741 published applications are hereby incorporated by reference herein in its entirety.

These improvements are particularly pronounced when coupled with sub-pixel rendering (SPR) systems and methods further disclosed in the above-referenced U.S. Patent documents and in commonly owned United States Patents and Patent Applications: (1) United States Patent Publication No. 2003/0034992 ("the '992 application") having application Ser. No. 10/051,612 and entitled "CONVERSION OF A SUB-PIXEL FORMAT DATA TO ANOTHER SUB-PIXEL DATA FORMAT," filed Jan. 16, 2002; (2) United States Patent Publication No. 2003/0103058 ("the '058 application") having application Ser. No. 10/150,355 entitled "METHODS AND SYSTEMS FOR SUB-PIXEL RENDERING WITH GAMMA ADJUSTMENT," filed May 17, 2002; (3) United States Patent Publication No. 2003/0085906 ("the '906 application") having application Ser. No. 10/215,843 and entitled "METHODS AND SYSTEMS FOR SUB-PIXEL RENDERING WITH ADAPTIVE FILTERING," filed Aug. 8, 2002; (4) United States Publication No. 2004/0196302 ("the '302 application") having application Ser. No. 10/379,767 and entitled "SYSTEMS AND METHODS FOR TEMPORAL SUB-PIXEL RENDERING OF IMAGE DATA" filed Mar. 4, 2003; (5) United States Patent Publication No. 2004/0174380 ("the '380 application") having application Ser. No. 10/379,765 and entitled "SYSTEMS AND METHODS FOR MOTION ADAPTIVE FILTERING," filed Mar. 4, 2003; (6) U.S. Pat. No. 6,917,368 ("the '368 Patent") entitled "SUB-PIXEL RENDERING SYSTEM AND METHOD FOR IMPROVED DISPLAY VIEWING ANGLES"; and (7) United States Patent Publication No. 2004/0196297 ("the '297 application") having application Ser. No. 10/409,413 and entitled "IMAGE DATA SET WITH EMBEDDED PRE-SUBPIXEL RENDERED IMAGE" filed Apr. 7, 2003. Each of the aforementioned '992, '058, '906, '302, 380 and '297 applications and the '368 patent are hereby incorporated by reference herein in its entirety.

Improvements in gamut conversion and mapping are disclosed in commonly owned United States Patents and copending United States Patent Applications: (1) U.S. Pat. No. 6,980,219 ("the '219 Patent") entitled "HUE ANGLE CAL- CULATION SYSTEM AND METHODS"; (2) United States Patent Publication No. 2005/0083341 ("the '341 application") having application Ser. No. 10/691,377 and entitled "METHOD AND APPARATUS FOR CONVERTING FROM SOURCE COLOR SPACE TO TARGET COLOR SPACE", filed Oct. 21, 2003; (3) United States Patent Publication No. 2005/0083352 ("the '352 application") having application Ser. No. 10/691,396 and entitled "METHOD AND APPARATUS FOR CONVERTING FROM A SOURCE COLOR SPACE TO A TARGET COLOR SPACE", filed Oct. 21, 2003; and (4) United States Patent Publication No. 2005/0083344 ("the '344 application") having application Ser. No. 10/690,716 and entitled "GAMUT CONVERSION SYSTEM AND METHODS" filed Oct. 21, 2003. Each of the aforementioned '341, '352 and '344 applications and the '219 patent is hereby incorporated by reference herein in its entirety.

Additional advantages have been described in (1) United States Patent Publication No. 2005/0099540 ("the '540 application") having application Ser. No. 10/696,235 and entitled "DISPLAY SYSTEM HAVING IMPROVED MULTIPLE MODES FOR DISPLAYING IMAGE DATA FROM MULTIPLE INPUT SOURCE FORMATS", filed Oct. 28, 2003; and in (2) United States Patent Publication No. 2005/0088385 ("the '385 application") having application Ser. No. 10/696,026 and entitled "SYSTEM AND METHOD FOR PERFORMING IMAGE RECONSTRUCTION AND SUBPIXEL RENDERING TO EFFECT SCALING FOR MULTI-MODE DISPLAY" filed Oct. 28, 2003, each of which is hereby incorporated herein by reference in its entirety.

Additionally, each of these co-owned and co-pending applications is herein incorporated by reference in its entirety: (1) United States Patent Publication No. 2005/0225548 ("the '548 application") having application Ser. No. 10/821,387 and entitled "SYSTEM AND METHOD FOR IMPROVING SUB-PIXEL RENDERING OF IMAGE DATA IN NON-STRIPED DISPLAY SYSTEMS"; (2) United States Patent Publication No. 2005/0225561 ("the '561 application") having application Ser. No. 10/821,386 and entitled "SYSTEMS AND METHODS FOR SELECTING A WHITE POINT FOR IMAGE DISPLAYS"; (3) United States Patent Publication No. 2005/0225574 ("the '574 application") and United States Patent Publication No. 2005/0225575 ("the '575 application") having application Ser. Nos. 10/821,353 and 10/961,506 respectively, and both entitled "NOVEL SUBPIXEL LAYOUTS AND ARRANGEMENTS FOR HIGH BRIGHTNESS DISPLAYS"; (4) United States Patent Publication No. 2005/0225562 ("the '562 application") having application Ser. No. 10/821,306 and entitled "SYSTEMS AND METHODS FOR IMPROVED GAMUT MAPPING FROM ONE IMAGE DATA SET TO ANOTHER"; (5) United States Patent Publication No. 2005/0225563 ("the '563 application") having application Ser. No. 10/821,388 and entitled "IMPROVED SUBPIXEL RENDERING FILTERS FOR HIGH BRIGHTNESS SUBPIXEL LAYOUTS"; and (6) United States Patent Publication No. 2005/0276502 ("the '502 application") having application Ser. No. 10/866,447 and entitled "INCREASING GAMMA ACCURACY IN QUANTIZED DISPLAY SYSTEMS."

Additional improvements to, and embodiments of, display systems and methods of operation thereof are described in: (1) Patent Cooperation Treaty (PCT) Application No. PCT/US 06/12768, entitled "EFFICIENT MEMORY STRUCTURE FOR DISPLAY SYSTEM WITH NOVEL SUBPIXEL STRUCTURES" filed Apr. 4, 2006; (2) Patent Cooperation Treaty (PCT) Application No. PCT/US 06/12766, entitled "SYSTEMS AND METHODS FOR IMPLEMENTING LOW-COST GAMUT MAPPING ALGORITHMS" filed Apr. 4, 2006; (3) U.S. patent application Ser. No. 11/278,675, entitled "SYSTEMS AND METHODS FOR IMPLEMENTING IMPROVED GAMUT MAPPING ALGORITHMS" filed Apr. 4, 2006, and published as United States Patent Application Publication 2006/0244686; (4) Patent Cooperation Treaty (PCT) Application No. PCT/US 06/12521, entitled "PRE-SUBPIXEL RENDERED IMAGE PROCESSING IN DISPLAY SYSTEMS" filed Apr. 4, 2006; and (5) Patent Cooperation Treaty (PCT) Application No. PCT/US 06/19657, entitled "MULTIPRIMARY COLOR SUBPIXEL RENDERING WITH METAMERIC FILTERING" filed on May 19, 2006. Each of these co-owned applications is also herein incorporated by reference in its entirety.

As explained in some of the above patent applications, an image 104 (FIG. 1) is represented by a number of areas 106 (FIG. 1) called pixels. Each pixel 106 is associated with a color that should be substantially reproduced by a set of subpixels in a display 110. Conventionally, each subpixel displays a "primary" color, i.e. each conventional subpixel is associated with some hue and saturation. Other colors are obtained by mixing primary colors. Each pixel 106 is mapped into a set of one or more subpixels which are to display the pixel's color.

In some displays, each repeating set of subpixels includes a subpixel for each primary color. The subpixels are small, and are spaced closely together, to provide a desired resolution. This structure is not cost-effective however because it does not match the resolution of human vision. Humans are more perceptive to luminance differences than to chromatic differences. Therefore, some displays map an input pixel 106 into a subpixel repeating set that does not include only the subpixels of each primary color. The chromatic resolution is reduced, but the luminance resolution remains high.

One such display 110 is described in PCT application published as no. WO 2006/127555 A2 on 30 November 2006 and U.S. patent application Ser. No. 11/278,675 published as no. 2006/0244686 A1 on 2 Nov. 2006 and illustrated in FIG. 1. The display 110 is of RGBW type, with red subpixels 120R, blue subpixels 120B, green subpixels 120G, and white subpixels 120W. All these subpixels 120 are equal in area. Each set of subpixels consists of two adjacent subpixels in the same row. These sets 124 are called "pairs" below. Each pair 124 consists of either a red subpixel 120R and a green subpixel 120G (such pairs are called "RG pairs" below), or each pair consists of a blue subpixel 120B and a white subpixel 120W ("BW pair"). In each RG pair, the red subpixel is to the left of the green one. In each BW pair, the blue subpixel is on the left. The RG and BW pairs alternate in each row and each column.

Each pixel 106 in column x and row y of the image (pixel "$\mathbf{106}_{x,y}$" below) is mapped into the subpixel pair 124 in column x and row y ("$\mathbf{124}_{x,y}$" below). In display 110, the consecutive indices x and y denote consecutive pairs, not consecutive subpixels. Each pair 124 has only two subpixels, and provides a high range and resolution in luminance but not in chrominance. Therefore, part of the input pixel's luminance may have to be shifted to adjacent pairs 124 in a "subpixel rendering" operation (SPR) described in some of the aforementioned patent applications and illustrated in FIG. 2.

FIG. 2 illustrates the SPR operation for the red and green subpixels. The blue and white subpixels are treated in a similar manner. The SPR operation calculates the values Rw, Gw, Bw, Ww defining the luminances for the respective read, green, blue and white subpixels in a linear manner, i.e. the luminances are linear functions of the subpixel values (different functions may be used for different primary colors). The Rw, Gw, Bw, Ww values are then used to determine electrical signals provided to the subpixels to obtain the desired luminances.

FIG. 2 shows the pixels 106 superimposed onto the respective subpixel pairs 124. The blue and white subpixels are not shown. The display area is subdivided into "sampling" areas 250 centered at the respective RG pairs 124. The sampling areas 250 can be defined in different ways, and in FIG. 2 diamond-shaped areas 250 are chosen. The areas 250 are congruent to each other except at the edges of the display.

The color of each pixel 106 is expressed in a linear RGBW color coordinate system. For each RG pair $\mathbf{124}_{x,y}$, the Rw value of the red subpixel is determined as a weighted sum of the R coordinates of all the pixels 106 which overlap with the sampling area 250 centered at the RG pair $\mathbf{124}_{x,y}$. The weights are chosen to add up to 1, and are proportional to the areas of overlap of the respective pixels 106 with the sampling area 250. In particular, if the subpixel pair $\mathbf{124}_{x,y}$ is not at the edge of the display, then the red value Rw is:

$$Rw=\tfrac{1}{2}*R_{x,y}+\tfrac{1}{8}*R_{x-1,y}+\tfrac{1}{8}*R_{x+1,y}+\tfrac{1}{8}*R_{x,y-1}+\tfrac{1}{8}*R_{x,y+1} \quad (1)$$

In other words, the red subpixels 120R can be rendered by applying a 3×3 diamond filter to the R coordinates of the respective pixels 106 with the following filter kernel:

$$\begin{pmatrix} 0 & 1/8 & 0 \\ 1/8 & 1/2 & 1/8 \\ 0 & 1/8 & 0 \end{pmatrix} \quad (2)$$

The same filter kernel can be used for the green, blue and white subpixels (except at the edges). Other filter kernels can also be used. See e.g. the aforementioned United States Patent Publication No. 2005/0225563.

The luminance shifts performed in the sub-pixel rendering may undesirably cause image degradation such as blurriness or loss of local contrast. The image can be improved by applying sharpening filters (e.g. DOG, i.e. Difference of the Gausians). See e.g. the aforementioned PCT application WO 2006/127555. Additional improvements in image quality are desirable.

Further, some of the operations described above may cause some subpixel values to be out of gamut, especially if the gamut is restricted in brightness to reduce power consumption. Forcing the subpixel values into the available gamut may distort the image, e.g. reduce local contrast, and such distortion should be minimized. It is desirable to improve gamut mapping operations, especially in low brightness environments.

SUMMARY

This section summarizes some features of the invention. Other features may be described in the subsequent sections.

FIG. 3 illustrates a block diagram of a display apparatus that can be used with some embodiments of the present invention. This can be a liquid crystal display (LCD) for example. The display unit 110 can be as in FIG. 1. Light emitted by backlight unit 310 passes through the subpixels of display 110 to an observer 314. The image data 104 are supplied in digital form to an image processing circuit 320 which performs subpixel rendering as in FIG. 2 and possibly some other operations, and provides subpixel values R, G, B, W to the display 110. These subpixel values are obtained from the Rw, Gw, Bw, Ww values generated in the SPR process by suitable modification (for example, gamma conversion if the luminances provided by the display unit 110 are non-linear functions of the subpixel values received by the display unit). Each subpixel value provided to the display unit 110 defines how much light must be transmitted by the corresponding subpixel to obtain the desired image. Image processing circuit 320 also provides to backlight unit 310 a control signal BL specifying the backlight unit's output power. To reduce power consumption, the output power BL should be only as high as needed for the highest subpixel value in the image. Therefore, the output power BL can be controlled dynamically depending on the subpixel values. This is called Dynamic Backlight Control (DBLC). Circuit 320 adjusts the subpixel values RGBW to make the subpixels more transmissive if BL is lower. In particularly power conscious environments (e.g. in battery operated systems such as mobile telephones), the BL value is lower than needed for the highest subpixel value. This is called "aggressive DBLC". Aggressive DBLC may lead to a loss of contrast.

FIG. 4 illustrates the data path in some embodiments of circuit 320. Block 410 converts the image 104 (the color of each pixel 106) to a linear color space, e.g. linear RGB. Block 420 converts the image from the linear RGB space to the linear RGBW representation. Block 430 uses the linear RGBW data to determine the output power signal BL for the backlight unit for the DBLC or aggressive DBLC operation, and provides the signal BL to the backlight unit 310. Block 420 also provides information on the signal BL to block 444. Block 444 uses this information to scale the RGBW coordinates to adjust for the backlight unit's output power BL. The scaling operation may drive some colors out of the gamut of the display 110, especially in aggressive DBLC. Block 450 performs a gamut clamping (gamut mapping) operation to replace the out of gamut colors by colors in the gamut.

Block 454 performs subpixel rendering (e.g. as in FIG. 2) on the output of block 450. In addition, sharpening filters can be applied. An example is "meta luma" sharpening ("metamer luminance" sharpening) described in the aforementioned PCT application WO 2006/127555 and U.S. patent application published as 2006/0244686 on Nov. 2, 2006, both incorporated herein by reference. More particularly, the conversion from RGB to RGBW in block 420 is not unique in the sense that the same color may have different RGBW representations. Such representations are called "metamers" in some literature. (Other literature uses the word "metamers" to denote electromagnetic waves of different spectral power distributions perceived as the same color, but different RGBW representations do not necessarily mean different spectral power distributions.) The meta luma sharpening selects the metamer for each pixel 106 based on the relative brightness of the pixel 106 with respect to the surround. Suppose that the pixel 106 is brighter than the surrounding pixels immediately above, below, to the right and to the left. If the bright pixel 106 is mapped to a BW pair 124, then it is desirable to select the metamer with a larger W coordinate to increase the luminance of the BW pair. If the bright pixel 106 is mapped to an RG pair, then it is desirable to select a metamer with larger R and G coordinates, and hence a smaller W coordinate.

Another example of sharpening is Difference of the Gaussians. Other types of sharpening can also be applied.

The resulting subpixel values are provided to display 110 (possibly after gamma conversion if the subpixel luminances in display 110 are not linear functions of the subpixel values).

FIG. 4 is not an exhaustive representation of all operations that can be performed. For example, dithering and other operations may be added. Also, the operations do not have to be performed in separately or in the order depicted.

The display 110 of FIG. 1 can display some features better (sharper) than others. For example, horizontal lines can be made fairly sharp because each row of subpixels 120 includes subpixels of all the primary colors (red, green, blue and white). Vertical lines are also sharp for a similar reason. However, diagonal lines are harder to make sharp because each diagonal of subpixel pairs 124 includes only BW pairs or only RG pairs. If image 104 has a diagonal line mapped into a diagonal of RW pairs 124 or a diagonal of BW pairs, the line may become fuzzy due to the luminance shift performed in the SPR operation. Suppose for example that a red diagonal line D (FIG. 5) is mapped into BW pixel pairs 124. The SPR operation will shift the red energy to the adjacent diagonals A, B (mapped into the RG pairs) in equal amounts, so the diagonal line D will become fuzzy.

In some embodiments of the present invention, the SPR operation is modified to shift more energy from D to one of the adjacent diagonals A and B than to the other one of A and B. The diagonal line D will appear sharper as a result.

Further, in a conventional LCD display, data are displayed in frames. A frame is a time interval needed to display a whole image 104. The data processing of FIG. 4 is performed for each frame (e.g. 60 or more frames per second) even if the image does not change. This is inefficient in various respects including power consumption, use of data processing resources (e.g. microprocessor resources in circuit 320), the time needed to display changes in the image, etc. Therefore, for each new frame, it is desirable to minimize processing of the unchanged image portions. In particular, it is desirable to avoid re-doing the SPR processing (block 454) on the unchanged image portions. This however is difficult in the embodiment of FIG. 4 because even small changes in the image may affect the maximum value of the RGBW coordinates generated by block 420, and hence may affect the BL value generated by block 430. If the BL value is changed, then the scaling and gamut clamping operations (444, 450) may have to be redone over the whole image.

FIG. 6 shows an alternative embodiment, in which scaling (444), gamut clamping (450), and determining BL value (430) are performed after the SPR. Here the SPR output can be stored in a frame buffer 610, and the operations 410, 420, 454 can be performed, in each frame, only on the changed portions of the image (the changed portions can be determined before the operation 410.) This embodiment reduces replicate processing of unchanged image portions. However, the gamut clamping (450) may lead to a loss of local contrast as described above, and this loss is not corrected by the sharpening operations performed in conjunction with the SPR. Therefore, in some embodiments of the present invention, other types of sharpening are performed by block 450, particularly for diagonal lines. For example, suppose that the diagonal line D (FIG. 5) is a dark line surrounded by bright saturated colors. Bright saturated colors are likely to be out of gamut because their luminance cannot be fully shared by the white subpixels. The dark line D will likely be in-gamut. A conventional gamut clamping operation would reduce the luminance of the surrounding subpixels to reduce the contrast with the line D and possibly make the line D almost invisible. In some embodiments, the gamut clamping detects dark diagonal lines on bright saturated surround and reduces the dark diagonal lines' luminance to improve the local contrast.

The invention includes embodiments that improve image quality at relatively low cost. More particularly, circuit 320 can be constructed to thoroughly analyze the image 104 and provide the best image quality for any type of image, and such circuits are within the scope of the invention, but such circuits can be large and/or complex and/or slow. In some embodiments, the image analysis is simplified to provide high image quality for many images at reasonable cost.

The invention is not limited to the features and advantages described above except as defined by the appended claims. For example, the invention is not limited to the displays 110 of FIG. 1, to RGBW displays, or to displays in which some diagonal lines carry less chromatic information than horizontal or vertical lines. Some embodiments sharpen non-diagonal features.

BRIEF DESCRIPTION OF THE DRAWINGS

FIG. 4 illustrates a data path in some embodiments of the display device of FIG. 3.

FIG. 5 illustrates an image with diagonal lines.

DESCRIPTION OF SOME EMBODIMENTS

The embodiments described in this section illustrate but do not limit the invention.

Figure 1:
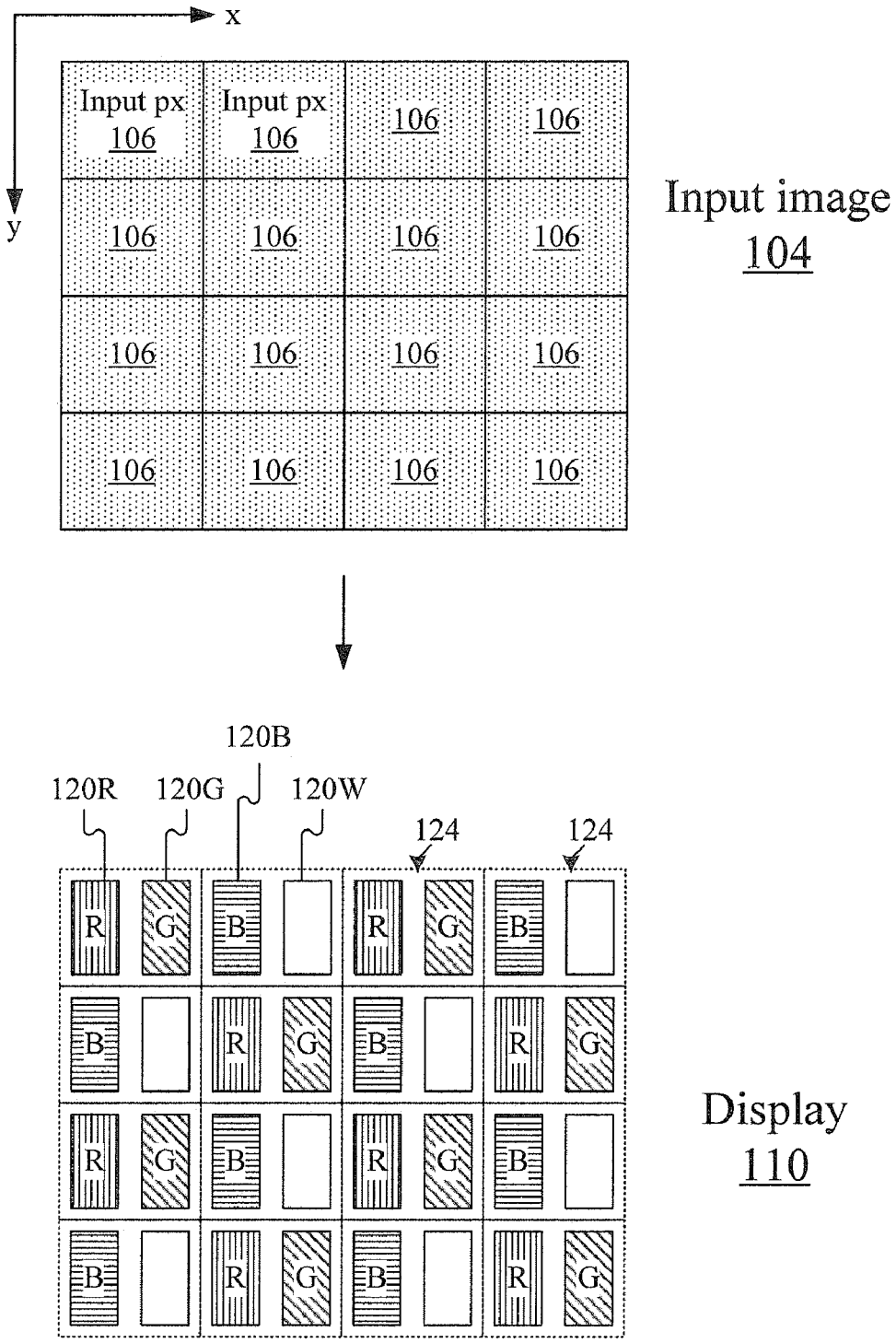
FIG. 1 PRIOR ART
FIG. 1 illustrates a prior art mapping of an image consisting of pixels into a display with subpixels.
Figure 3:
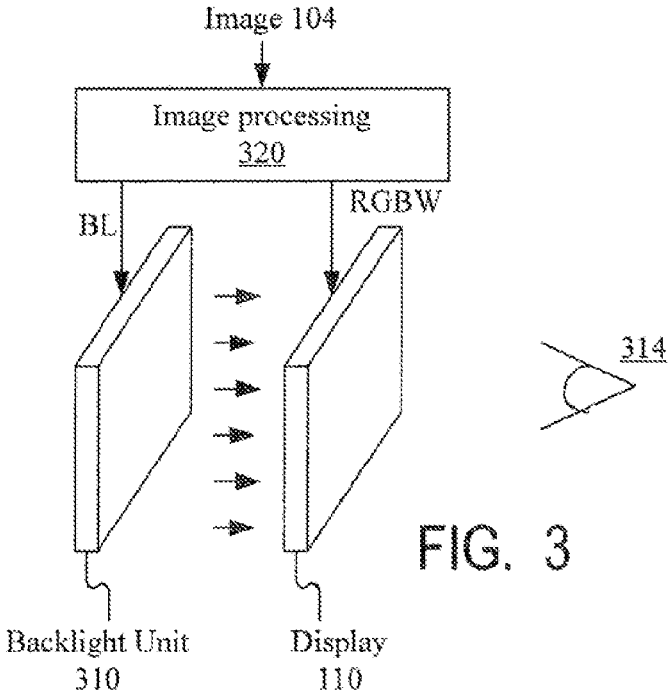
FIG. 3 is a block diagram of a display device according to some embodiments of the present invention.

Some embodiments of the present invention will now be described on the example of the display unit 110 of FIGS. 1 and 3. The data processing will be assumed as in FIG. 4 or 6.

Conversion to RGBW (step 420). For the sake of illustration, let us suppose that block 410 outputs, for each pixel 106, color coordinates r, g, b in a linear RGB color space. Each of the r, g, b coordinates is an integer allowed to vary from 0 to some maximum number MAXCOL inclusive. For example, if r, g, and b are represented in 8 bits, then MAXCOL=255. In some embodiments, the color coordinates are stored in more bits to avoid loss of precision. For example, if the pixel colors are initially represented in a non-linear color space (e.g. sRGB), with each coordinate being an 8-bit value, then conversion to the linear RGB color space ("gamma conversion") may produce fractional values for r, g, and b. To reduce quantization errors, each of r, g, b can be represented in 11 bits, with MAXCOL=2047.

The color r=g=b=0 is absolute black, and the color r=g=b=MAXCOL is the brightest possible white. We will assume that RGBW is a linear representation in which each of R, G, B, W is an integer allowed to vary from 0 to MAXCOL inclusive. The brightest RGB white is converted to the brightest RGBW white, whose coordinates are R=G=B=W=MAXCOL. These assumptions are not limiting. MAXCOL can be different for different coordinates (r, g, b, R, G, B, W), and other variations are possible.

It is well known that under these assumptions, the conversion can be performed to satisfy the following equations:

$$r=M_0R+M_1W$$

$$g=M_0G+M_1W$$

$$b=M_0B+M_1W \quad (3)$$

where $M_0$ and $M_1$ are constants corresponding to the luminance characteristics of pixels 120 as follows:

$$M_0=(Y_r+Y_g+Y_b)/(Y_r+Y_g+Y_b+Y_w)$$

$$M_1=Y_w/(Y_r+Y_g+Y_b+Y_w) \quad (4)$$

where $Y_r$, $Y_g$, $Y_b$, $Y_w$ are defined as follows. $Y_r$ is the luminance of display 110 when the backlight unit 310 is run at some reference output power (e.g. the maximum power), all the red subpixels 120R are maximally transmissive, and all the remaining subpixels are minimally transmissive. The values $Y_g$, $Y_b$, $Y_w$ are defined in a similar manner for the green, blue, and white subpixels.

If the W coordinate is known, then the R, G, and B coordinates can be computed from (3). The equations (3) clearly require that if r, g, or b is zero, then W must be zero. If r=g=b=MAXCOL, then W=MAXCOL. However, for many colors, W can be chosen in a number of ways (to define one or a number of metamers). In order for each of R, G, B, W to be in the range of 0 to MAXCOL, W must be in the following range:

$$\min W \leqq W \leqq \max W$$

where $$\min W=[\max(r,g,b)-M_0*\mathrm{MAXCOL}]/M_1$$

$$\max W=\min(r,g,b)/M_1$$

To provide high image quality with minimum output power BL, the R, G, B and W coordinates of each pixel 106 should preferably be close to each other. In some embodiments, W is set to max(r,g,b). Other choices for W are also possible. See the aforementioned U.S. patent application 2006/0244686 (Higgins et al.). For example, W can be set to some representation of luminance. After being computed as described above, the W value can be hard-clamped to the range of minW to maxW. (As used herein, "hard-clamping" a value to a range of some numbers A to B means setting the value to the low bound A if the value is below A, and setting the value to the high bound B if the value is above B.)

Equations (3) may require the values R, G, B to exceed MAXCOL and be as high as MAXCOL/$M_0$. For example, if b=0, then W=0; if r=g=MAXCOL, then R=G=MAXCOL/$M_0$. For the sake of illustration, we will assume that $M_0=M_1=½$, i.e. the white subpixels are as bright as the red, green and blue subpixels. In this case, the R, G, and B values can be as high as 2*MAXCOL. The display 110 accepts only colors whose linear RGBW coordinates do not exceed MAXCOL. To display the other colors, the backlight unit's power BL can be multiplied by $1/M_0$ (i.e. doubled if $M_0=½$), and the RGBW coordinates multiplied by $M_0$ (divided by 2). However, to save power, some embodiments do not increase the backlight unit' power or they increase the backlight unit's power by a multiple less than $1/M_0$. The resulting loss of contrast may be severe as illustrated in FIG. 7A. FIG. 7A illustrates exemplary maximum subpixel values for the diagonal D (FIG. 5) and the adjacent diagonals A, AA above D and the diagonals B, BB below D at different stages of the process of FIG. 6. Suppose that the diagonal D is dark (e.g. absolute black) and the diagonals A, AA, B, BB are bright saturated red (i.e. the coordinate r is near MAXCOL, and g and b are near 0). In this case (see section I of FIG. 7A), block 420 will set W to be near 0 on all the diagonals. On diagonal D, the values R, G, B will also be near 0. On the remaining diagonals, R will be near 2*MAXCOL, and G and B will be near 0.

Suppose that the diagonal D is mapped into the RG pairs. Section II of FIG. 7A shows the subpixel values after the SPR step 454. The diamond filter (1), (2) shifts the red luminance from diagonals A, B to the red subpixels on diagonal D with a weight ½. Hence, the red subpixels' values on diagonal D become close to MAXCOL. The diagonals A and B are mapped into the BW pairs and hence are quite dark. The diagonals AA and BB remain bright saturated red (the red subpixels' values are near 2*MAXCOL). Even if the backlight unit power is increased (e.g. doubled), there is a contrast loss because the contrast between the diagonal D and the adjacent diagonals A, AA, B, BB is reduced compared to section I (before SPR).

Further, let us assume that the backlight unit power is not increased, i.e. is kept at a level sufficient only for the pixel values not exceeding MAXCOL. Then the diagonals AA and BB will be out of gamut. Section III of FIG. 7A shows the subpixel values after the gamut clamp 450. The maximum subpixel values on the diagonals AA, BB are brought down to about MAXCOL, and the maximum subpixel values on the diagonal D are slightly decreased but remain close to MAXCOL. Thus, the high contrast between the diagonal D and the surrounding pixels in the original image is almost entirely lost.

Meta luma sharpening operation exacerbates the contrast loss because on the diagonal D, the metamers will be selected to have a lower W value, and hence higher R and G values, thus possibly increasing the luminance on the diagonal.

Figure 6:
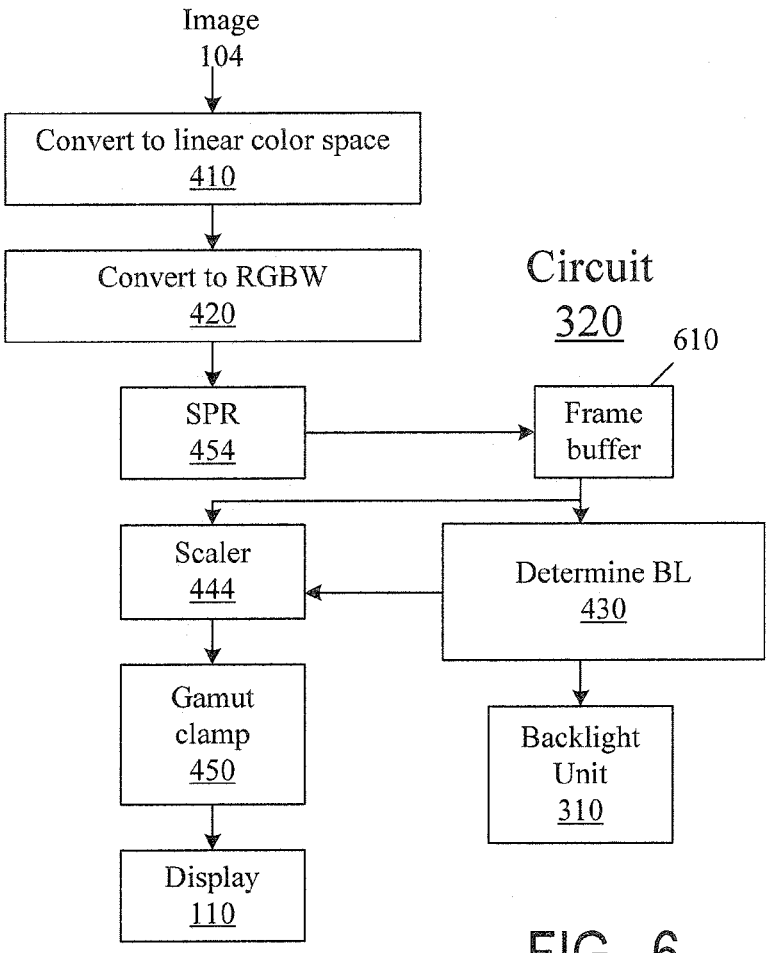
FIG. 6 illustrates a data path in some embodiments of the display device of FIG. 3.
Figure 7A:
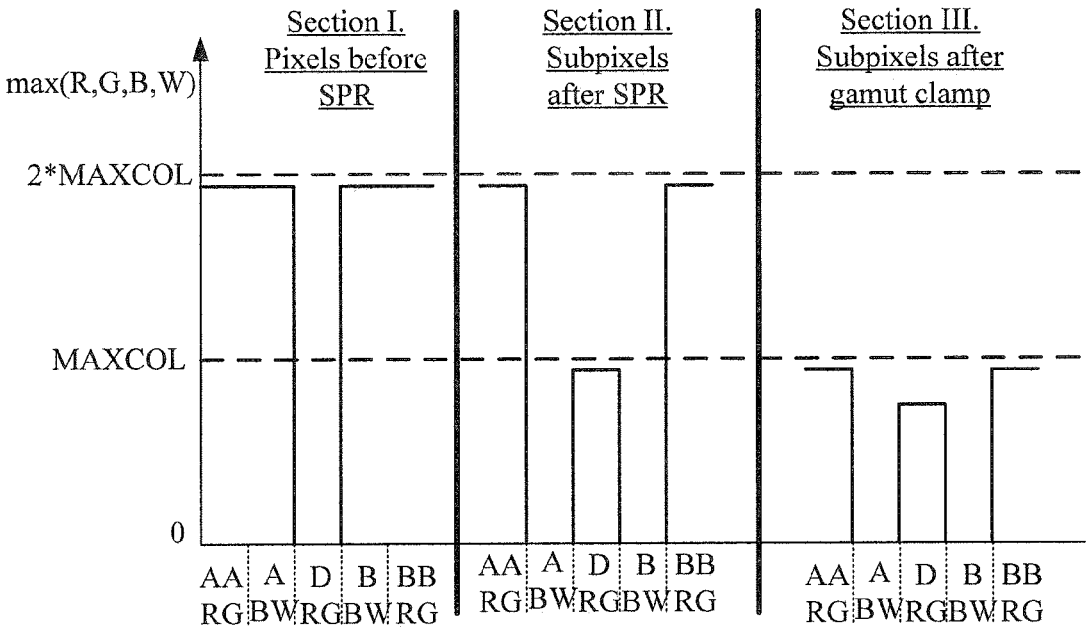
FIGS. 7A, 7B illustrate possible subpixel values at different stages of processing of the image of FIG. 5.

In some embodiments of the present invention, at steps 444 (Scaler) and 450 (Gamut clamp) of FIG. 6, a check is made for "black holes" (i.e. features like in FIG. 7A section II). If a black hole is detected, then the subpixel values inside the black hole (on diagonal D) are reduced by a greater amount than if then if there is no black hole. This is described in more detail below in connection with FIGS. 9-10.

Figure 7B:
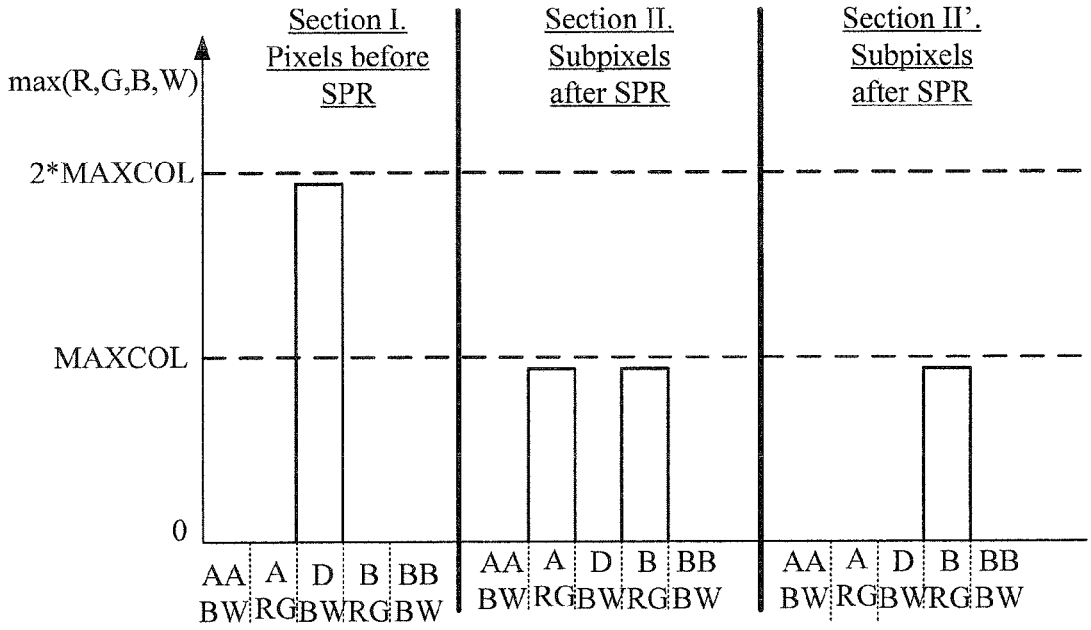

Loss of contrast may also occur if the diagonal D is bright saturated red mapped into BW pairs, and the surrounding pixels 106 are dark. See FIG. 7B section I. The SPR operation shifts the red luminance from diagonal D to A and B. See FIG. 7B section II. The red line D will become wider and hence possibly fuzzy. In some embodiments of the present invention, the diamond filter and the meta luma sharpening are suppressed at or near diagonals, and all or almost all the luminance is shifted from D to one but not both of A and B (to diagonal B in the example section II' in FIG. 7B). For instance, an asymmetric box filter can be used for this purpose.

Figure 8:
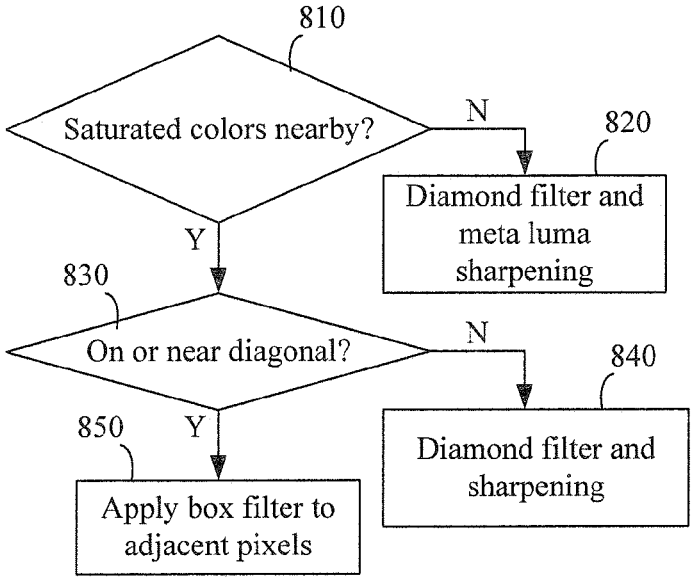
FIG. 8 is a flow chart of subpixel rendering according to some embodiments of the present invention.

FIG. 8 illustrates a flow chart of subpixel rendering operation 454 in some embodiments of the present invention. For each pixel $\mathbf{106}_{x,y}$, a test is run at step 810 to determine if the pixel is in a saturated color area. In particular, in some embodiments, the test determines if the pixel $\mathbf{106}_{x,y}$ or any pixel immediately to the right, left, above or below contains a saturated color. If the answer is No, then conventional processing is performed at step 820, e.g. the diamond filter (1), (2) is applied to pixel $\mathbf{106}_{x,y}$ and meta luma sharpening is performed. Of note, the pixels 106 at the edge of the display can be processed using the same filters and setting coordinates of non-existing pixels beyond the edge to some predefined values, e.g. zero. Alternatively, the non-existing pixels 106 beyond the edge can be defined by mirroring the pixels at the edge. For example, if the left edge is defined as x=0 and the right edge as $x=x_{max}$, then the non-existing pixels beyond the left and right edges can be defined as $\mathbf{106}_{-1,y}=\mathbf{106}_{0,y}$ and $\mathbf{106}_{x_{max}+1,y}=\mathbf{106}_{x_{max},y}$. If y changes from 0 to $y_{max}$, then $\mathbf{106}_{-1,y}=\mathbf{106}_{0,y}$ and $\mathbf{106}_{x,y_{max}+1}=\mathbf{106}_{x,y_{max},y}$. Also, if needed (e.g. for the DOG filter), one can define the non-existing corner pixels as $\mathbf{106}_{-1,-1}=\mathbf{106}_{0,0}$ and one can mirror the pixels at the other three corners in a similar manner. Similar processing of edges and corners (using the mirrored values or predefined values) can be performed in other filtering operations described herein.

If the answer is Yes, then a check is made (step 830) if the pixel $\mathbf{106}_{x,y}$ is on or near a diagonal line. If the answer is No, then (step 840) the diamond filter (1), (2) is applied. However, the meta luma sharpening is not performed because for the saturated colors W is near zero and therefore the choice of metamers is so limited that the meta luma sharpening is of little benefit. Instead, the image can be sharpened using, for example, same color sharpening on in some other way. Some embodiments perform same color sharpening using a DOG (Difference of the Gaussians) filter. An exemplary filter kernel for the DOG filter is:

$$\begin{pmatrix} -1/16 & 0 & -1/16 \\ 0 & 1/4 & 0 \\ -1/16 & 0 & -1/16 \end{pmatrix} \tag{6}$$

This filter is applied to each subpixel 120 of the pixel pair $\mathbf{124}_{x,y}$ for the corresponding color plane. For example, if the pixel pair $\mathbf{124}_{x,y}$ is an RG pair, then the R subpixel is rendered by summing the output of diamond filter (1), (2) with the output of the DOG filter (6). Both filters operate on the red plane, i.e. on the R coordinates output by block 420. The green subpixel is similarly rendered. The processing of the BW pairs is similar.

In other embodiments, meta luma sharpening can be performed at step 840 and/or the DOG filter (6) can be applied at step 820. Other types of sharpening can also be used at these two steps.

If the answer is Yes at step 830, then box filtering is performed to shift the pixel energy to one but not both of the adjacent diagonals. An exemplary filter kernel is:

$$(0,½,½) \tag{7}$$

Table 1 below illustrates simulation code for one embodiment of the SPR operation 454 of FIG. 6. The simulation code is written in the well known programming language LUA. This language is similar to C. This is a simple, cost-effective implementation which does not necessarily implement all the features described above. Table 2 illustrates pseudocode for this embodiment.

In Table 1, "spr.band" is a bitwise-AND function, "spr.bor" is bitwise-OR, and spr.bxor is bitwise XOR.

In this implementation, the blue plane is shifted left or right by one pixel 106. This phase shift means that the blue subpixels in BW pairs $\mathbf{124}_{x,y}$ are treated as if they were located at the center of the adjacent RG pair $\mathbf{124}_{x-1,y}$ or $\mathbf{124}_{x+1,y}$. For example, in the case of the left shift, the diamond filter (1), (2) calculates the blue subpixel value for the pair $\mathbf{124}_{x,y}$ as a weighted sum of the B coordinates of the pixel $\mathbf{106}_{x-1,y}$ and the four adjacent pixels. This is believed to provide more faithful hue display for some images. The direction of shift is to the left if FLIP_LEFT=0 (see line Spr5 in Table 1), and the direction is to the right if FLIP_LEFT=1. In the description below in this section, it is assumed for simplicity that the blue shift direction is to the left. The claims are not limited to the left shift unless indicated otherwise.

In this implementation, the step 830 checks for the patterns defined by the following 3×3 matrices as described in more detail below:

$$D1=\begin{pmatrix} 0 & 0 & 0 \\ 0 & 1 & 0 \\ 0 & 0 & 0 \end{pmatrix}$$

$$D2=\begin{pmatrix} 0 & 1 & 0 \\ 0 & 0 & 0 \\ 0 & 0 & 0 \end{pmatrix}$$

$$D3=\begin{pmatrix} 0 & 0 & 0 \\ 0 & 0 & 1 \\ 0 & 0 & 0 \end{pmatrix}$$

$$D4=\begin{pmatrix} 0 & 0 & 0 \\ 0 & 0 & 0 \\ 0 & 1 & 0 \end{pmatrix}$$

$$D5=\begin{pmatrix} 0 & 0 & 0 \\ 1 & 0 & 0 \\ 0 & 0 & 0 \end{pmatrix}$$

$$D6=\begin{pmatrix} 1 & 0 & 0 \\ 0 & 1 & 0 \\ 0 & 0 & 1 \end{pmatrix}$$

$$D7=\begin{pmatrix} 0 & 0 & 1 \\ 0 & 1 & 0 \\ 1 & 0 & 0 \end{pmatrix}$$

$$D8=\begin{pmatrix} 0 & 0 & 0 \\ 1 & 0 & 0 \\ 0 & 1 & 0 \end{pmatrix}$$

$$D9=\begin{pmatrix} 0 & 1 & 0 \\ 1 & 0 & 0 \\ 0 & 0 & 0 \end{pmatrix}$$

$$D10=\begin{pmatrix} 0 & 1 & 0 \\ 0 & 0 & 1 \\ 0 & 0 & 0 \end{pmatrix}$$

$$D11=\begin{pmatrix} 0 & 0 & 0 \\ 0 & 0 & 1 \\ 0 & 1 & 0 \end{pmatrix}$$

$$D12=\begin{pmatrix} 0 & 0 & 0 \\ 0 & 1 & 0 \\ 0 & 0 & 1 \end{pmatrix}$$

$$D13=\begin{pmatrix} 0 & 0 & 0 \\ 0 & 1 & 0 \\ 1 & 0 & 0 \end{pmatrix}$$

-continued $$D14 = \begin{pmatrix} 1 & 0 & 0 \\ 0 & 1 & 0 \\ 0 & 0 & 0 \end{pmatrix}$$

$$D15 = \begin{pmatrix} 0 & 0 & 1 \\ 0 & 1 & 0 \\ 0 & 0 & 0 \end{pmatrix}$$

For each pixel $\mathbf{106}_{x,y}$, each of these patterns D1-D15 can be checked separately on the pixel's R, G, and B coordinates, and possibly on the W coordinate. In some embodiments, if the pixel is mapped into an RG pair, then the patterns D1-D15 are checked on the R, G and B coordinates, and if the pixel is mapped into a BW pair, then the patterns are checked on the W coordinate. The check can be performed as follows. Each coordinate R, G, B, W is "thresholded" using some threshold value "BOBits". See lines F22-F26 in Table 1. In some embodiments, MAXCOL=2047 and BOBits=is between 128 and 1920 inclusive, e.g. 256. For example, let the thresholded values for the red, green, blue and white coordinates be denoted rth, gth, bth and wth respectively. If R≧BOBits, the thresholded value "rth" is set to 1, and otherwise rth is set to 0. The thresholded values gth, bth, wth are obtained for the G, B, and W coordinates in the same manner. Then filters D1-D15 are used on the thresholded values for each coordinate. For example, for any i and j, let $rth_{i,j}$ denote the thresholded rth value for the pixel $\mathbf{106}_{i,j}$. Then for the pixel $\mathbf{106}_{x,y}$, the output of filter D7 is 1 (i.e. the D7 pattern is recognized on the red plane) if one of the following conditions (T1), (T2) is true:

$$rth_{x,y}=rth_{x+1,y-1}=rth_{x-1,y+1}=1 \text{ and}$$

$$rth_{x-1,y-1}=rth_{x-1,y}=rth_{x,y-1}=rth_{x,y+1}=rth_{x+1,y}=rth_{x+1,y+1}=0 \quad \text{(T1):}$$

$$rth_{x,y}=rth_{x+1,y-1}=rth_{x-1,y+1}=0 \text{ and}$$

$$rth_{x-1,y-1}=rth_{x-1,y}=rth_{x,y-1}=rth_{x,y+1}=rth_{x+1,y}=rth_{x+1,y+1}=1 \quad \text{(T2):}$$

Otherwise, the filter output is 0, i.e. the D7 pattern is not recognized in the red plane.

Patterns D1-D5 correspond to single dots. Loss of contrast can occur at a dot pattern, so these patterns are treated like diagonals. Patterns D8-D11 indicate that the pixel $\mathbf{106}_{x,y}$ is near a diagonal. Patterns D12-D15 indicate that the pixel may be at an end of a diagonal.

In this implementation, step 810 is performed using the following filter:

$$Ortho = \begin{pmatrix} 0 & 1 & 0 \\ 1 & 1 & 1 \\ 0 & 1 & 0 \end{pmatrix}$$

This filter is applied to a saturation threshold plane using an OR operation. More particularly, for each pixel $\mathbf{106}_{x,y}$, a flag "sat" is computed which is equal to 1 if the saturation is high, and is equal to 0 otherwise. Possible "sat" computations are described below. Once the sat values have been computed, the Ortho filter is applied to a pixel $\mathbf{106}_{x,y}$. The filter output "ortho" is zero if sat=0 for the pixel and the four adjacent pixels above, below, to the right, and to the left. Otherwise, ortho=1. In some other embodiments, ortho is also set to 1 if there is a saturated pixel (with sat=1) in two of the four diagonally adjacent pixels (i.e. $\mathbf{106}_{x-1,y-1}$, $\mathbf{106}_{x-1,y+1}$, $\mathbf{106}_{x+1,y-1}$, $\mathbf{106}_{x+1,y+1}$). See Table 1 lines Spr23-Spr30 and Spr73-Spr80; Table 2 lines Ps2, Ps9, Ps10.

The sat value can be computed as follows. In some embodiments, for each pixel $\mathbf{106}_{x,y}$, the value sat is set to 0 if the following value "sin v" (saturation inverse) is above some threshold:

$$\sin v=\text{floor}[\min(r,g,b)/\max(1,r,g,b)] \quad (8)$$

where r, g, b are the input rgb coordinates. In other embodiments, the number formed by the upper bits of max(r,g,b), e.g. the four upper bits, is multiplied by some "saturation threshold", "STH" (e.g. 0, 1, 2, or greater), and four most significant bits of the product are considered. If they form a number greater than min(r,g,b), then sat is set to 1, and otherwise to zero.

In other embodiments, "sat" is computed from the RGBW coordinates generated by step 420. An exemplary computation is as follows. If R, G, or B above MAXCOL, then sat is set to 1. If not, the upper four most significant bits within MAXCOL are extracted for each of R, G, and B (e.g. bits [10:7] if MAXCOL=2047). The maximum of these four-bit values is multiplied by STH. The four most significant bits of the product form a number. If this number is greater than the number formed by the upper four most significant bits [10:7] of W, then "sat" is set to 1, and otherwise to 0. See Table 1, lines F37-F45 (SATBITS=4 to implement the example above). The invention is not limited to the number bits or other particulars.

In Table 1, "ortho" is computed in line Spr6. In addition, for a BW pair, "bortho" is computed as the Ortho filter output on the adjacent pixel to the left, and is used in determining the blue subpixel value (lines Spr59, Spr89-Spr91).

At step 810, the answer is Yes if the Ortho filter's output "ortho" is zero, and the answer is No otherwise. See Table 1 lines Spr34 (for an RG pair), Spr108 (for a BW pair). In processing the blue subpixel, "bortho" is used in a similar manner (line Spr96).

If a pixel $\mathbf{106}_{x,y}$ is mapped into an RG pair, the pixel's processing is described in lines Spr9-Spr53 in Table, 1, lines PS1-PS7 in Table 2. The adjacent blue subpixel to the right can be processed at the same time. More particularly, if ortho is 0 (line Spr34 in Table 1, line PS3 in Table 2), then the R, G and B subpixel values (Rw, Gw, Bw) are set to the output of diagonal filter (2) plus the meta luma sharpening value "a" described in Addendum A below before the claims. See step 820 in FIG. 8. In the embodiment of Table 1, the meta luma sharpening is simplified: instead of applying the diamond filter to the RGBW output (equation (A2) in Addendum A) of the meta luma sharpening operation, the diamond filter is applied to the RGBW coordinates as they stand before the meta luma sharpening operation, and the meta luma sharpening value "a" is added to the output of the diamond filter. This is done to speed up the SPR and reduce the storage requirements (by eliminating long-term storage for the RGBW output of the meta luma filter).

In line Spr39 of Table 1, line PS5 of Table 2, the value "diag" is 1 if, and only if, at least one pattern D1-D15 is recognized in at least one of the R and G coordinates of pixel $\mathbf{106}_{x,y}$. In this case, step 850 is performed. In particular, the R and G subpixel values are set to the output of box filter (7).

If diag is not 1, then step 840 is performed (lines Spr44-Spr45 in Table 1, line PS6 in Table 2). The R and G subpixel values are set to the sum of the outputs of diagonal filter (2) and DOG filter (6).

In line Spr47 of Table 1, line PS7 of Table 2, the value "bdiag" is 1 if, and only if, at least one pattern D1-D15 is recognized in the B coordinate of pixel $106_{x,y}$. In this case (line Spr48 in Table 1, line PS7 in Table 2), at step 850, the B subpixel value is set to the output of box filter (7).

If bdiag is not 1, then at step 840 (lines Spr51, PS7), the B subpixel value is set to the sum of the outputs of diagonal filter (2) and DOG filter (6).

If the pixel $106_{x,y}$ is mapped to a BW pair, it is processed as shown starting line Spr54 in Table 1, line PS8 in Table 2. In this case, the blue subpixel value is computed on the adjacent pixel to the left (i.e. with blue shift) as explained above. Thus, the blue subpixel processing is somewhat duplicative (although not entirely so), and is omitted in some embodiments. Alternatively, the blue subpixel processing in lines Spr9-Spr53 (for the RG pair) is omitted. In the simulation code of Table 1, the blue subpixel processing is performed twice, and the two results for the blue subpixel are stored in a memory (line Spr162). Subsequent processing can use either one of these two results.

The flags "ortho" and "bortho" are determined as described above.

In line Spr96 of Table 1, line PS11 of Table 2, if the Ortho filter output bortho is 0 on the adjacent pixel to the left, then the B subpixel value is set to the sum of the outputs of the diamond filter (2) and the meta sharpening filter value a (Addendum A). Both filters are computed on the pixel $106_{x-1,y}$. See line Spr97. Also, a flag "doedge" is set to 1 to perform special processing if the pixel $106_{x,y}$ is adjacent to the left or right edge of the screen as shown in lines Spr120-Spr141 of Table 1, line PS19 of Table 2. This processing is performed to improve the hue if the image contains vertical white lines at the screen edges. More particularly, if certain conditions hold as shown in Table 1, each of the blue and white subpixel values is computed as the sum of the diamond filter (2) and the DOG filter (6). See lines Spr137-Spr138. The filters are computed on the pixel $106_{x,y}$.

If bortho is not zero, then (step 830) diag is checked on the blue plane (lines Spr70, Spr100 of Table 1, line PS13 of Table 2). If diag is 1, then (line Spr101) the box filter (7) is applied (step 850). The box filter is computed on the pixel $106_{x-1,y}$ to output the average of the B coordinates of the pixels $106_{x,y}$ and $106_{x-1,y}$. Thus, if bortho is one for pixel $106_{x,y}$, ortho is one for pixel $106_{x-1,y}$, and diag is one for both pixels $106_{x-1,y}$ and $106_{x,y}$, then the box filter is applied so that the value of each of the corresponding subpixels 120R, 120G, 120B is the mean of the corresponding color coordinates R, G, B of the pixels $106_{x-1,y}$ and $106_{x,y}$. In some embodiments, the value of the corresponding subpixel 120W is also the mean of the W coordinates of the same pixels $106_{x-1,y}$ and $106_{x,y}$. In Tables 1 and 2 however the W subpixel value is computed differently as described below.

If diag is not 1 in lines Spr101 and PS13, then (step 840, lines Spr103, PS14) the B subpixel value is computed as the sum of the output of the diamond filter (2) and the DOG filter (6), both applied to the pixel $106_{x-1,y}$. (In Table 1, the variable blueshift is set to 1 if the blue shift is to the left as assumed in this discussion, or to −1 if the blue shift is to the right.) Also, doedge is set to 1 to perform the edge processing for the edge pixels as described above.

The W value is computed as shown starting in lines Spr108, PS15. If the Ortho filter output ortho on the pixel $106_{x,y}$ is 0, then the W subpixel value is set to the sum of the outputs of the diamond filter (2) and the meta sharpening filter value $a_{x,y}$, i.e. the value a (Addendum A). Both filters are computed on the pixel $106_{x,y}$. See line Spr109.

If ortho is not zero, then (step 830) diag is checked on the white plane (lines Spr111, Spr112, PS17). If diag is 1, then (line Spr113) the box filter (7) is applied (step 850). The box filter is computed on the pixel $106_{x,y}$ to output the mean of the W values for the pixel $106_{x,y}$ and the pixel $106_{x+1,y}$.

If diag is not 1, then (step 840, lines Spr115, PS18) the W subpixel value is computed as the sum of the output of the diamond filter (2) and the DOG filter (6). Both filters are applied to the pixel $106_{x,y}$ in the white plane.

The processing starting lines Spr143, PS19 is performed for all the pixels, i.e. the pixels mapped into RG pairs and the pixels mapped into BW pairs. In lines Spr147-Spr155, the subpixel values for the red, green and blue subpixels are hard-clamped to the maximum range of 0 to MAXOOG, where MAXOOG=2*MAXCOL+1 is the maximum possible RGBW value when M0=½ (see equations (3)). The white subpixels' values are hard-clamped to the range of 0 to MAXCOL.

In lines Spr126-Spr134 and some other passages, the values HS and VS denote the starting horizontal and vertical coordinates when updating only a portion of the screen. The simulation code of Table 1 assumes HS=VS=0. Also, the variables xsiz and ysiz contain this width and height of the screen portion being updated.

TABLE 1

SPR, LUA CODE

```
D1:     --*************************************************
D2:     --See Note 1 at end of Table 1 *****
D3:     BOBplane=0 --different planes are tested
D4:     function BOBtest(x,y,tab,plane) --tests one plane
D5:     local i,j
D6:     local rite,rong=0,0 --how many bits are right and wrong
D7:     BOBplane=plane --copy into global
D8:     for j=0,2 do
D9:         for i=0,2 do
D10:            local bit = spr.fetch("bin",x+i−1,y+j−1,BOBplane)
D11:            if bit == tab[i+j*3+1] then rite=rite+1 else
        rong=rong+1 end
D12:            end
D13:    end
D14:    if rite==9 or rong==9 then
D15:            return 1
D16:    end
D17:    return 0
D18:    end
F1:     function dplane(x,y,plane)      --check for diagonals and
        dots
F2:         if BOBtest(x,y,{
F3:                 0,0,0,                      --and dots
F4:                 0,1,0,
F5:                 0,0,0},plane) == 1 then return 1
F6:         elseif BOBtest(x,y,{
F7:                 0,1,0,
F8:                 0,0,0,
F9:                 0,0,0},plane) == 1 then return 1
F10:        elseif --... See note 2 at end of Table 1
F11:        end
F12:        return 0
F13:    end --function dplane
F14:
F15:    --*****************************************
F16:    --Separate pass to calculate the binary threshold bits
F17:    --(done in the SPR module in the hardware)
F18:        spr.create("bin",xsiz,ysiz,4,1)
F19:        if DEBUG_IMAGE== 1 then
        spr.create("BIN",xsiz,ysiz,3,1) end
F20:        spr.loop(xsiz,ysiz,1,1,function(x,y)
F21:          local r,g,b,w = spr.fetch(pipeline,x,y) --fetch
        data after GMA
F22:        if r<=BOBits then r=0 else r=1 end   --threshold
        each plane to a single bit
F23:        if g<=BOBits then g=0 else g=1 end
F24:        if b<=BOBits then b=0 else b=1 end
F25:         if w<=BOBits then w=0 else w=1 end
F26:        spr.store("bin",x,y,r,g,b,w)      --build the binary
        thresholded image
```

TABLE 1-continued

SPR, LUA CODE

```
F27:            if DEBUG_IMAGE==1 then
    spr.store("BIN",x,y,b*127+w*127,g*127+w*127,r*127+w*127)
    end          --DIAGNOSTIC: make a visible version for looking
    at end)
F28:      --*************************************
F29:      --Separate pass to calculate the saturation threshold
F30:         spr.create("sinv",xsiz,ysiz,1,2) --saturation bit
    image for SPR
F31:      if DEBUG_IMAGE==1 then
    spr.create("SINV",xsiz,ysiz,3,1) end --diagnostic image
F32:         spr.loop(xsiz,ysiz,1,1,function(x,y)
F33:            local sat=0            --assume desaturated
F34:            local Rw,Gw,Bw,Ww,Lw,Ow=spr.fetch("gma",x,y)    --
    fetch values after GMA
F35:            Lw = math.floor((Rw*2 + Gw*5 + Bw + Ww*8)/16) --re-
    calc luminance
F36:            spr.store("gma",x,y,Rw,Gw,Bw,Ww,Lw,Ow)
          --and write it out
F37:                SATBITS=SATBITS or 2048          --2^number of bits
    in saturation calculation
F38:                local R=math.floor(SATBITS*Rw/(MAXCOL+1))
          --right shift them leaving 12 bits
F39:                local G=math.floor(SATBITS*Gw/(MAXCOL+1))
F40:                local B=math.floor(SATBITS*Bw/(MAXCOL+1))
F41:                local W=math.floor(SATBITS*Ww/(MAXCOL+1))
F42:                if (math.floor(STH*math.max(R,G,B)/16))>W then
F43:                   sat=1
F44:                end
F45:            spr.store("sinv",x,y,sat)          --save this for the
    SPR module
F46:            if DEBUG_IMAGE==1 then
F47:                sat = sat*255              --convert to a white
    pixel if on
F48:                spr.store("SINV",x,y,sat,sat,sat) --for a
    diagnostic image
F49:            end
F50:         end)
F51:            --Filters
F52:      diamond = --normal diamond filter
F53:      {
F54:         xsize=3,ysize=3,
F55:          0,  32,  0,
F56:         32, 128, 32,
F57:          0,  32,  0
F58:      }
F59:      metasharp =       --metamer sharpen filter
F60:      {
F61:         xsize=3,ysize=3,
F62:          0, −32,    0,
F63:        −32, 128, −32,
F64:          0, −32,    0
F65:      }
F66:      --selfsharp =    --self sharpening filter
F67:      --{
F68:      --    xsize=3,ysize=3,
F69:      --  −32,    0, −32,
F70:      --     0, 128,    0,
F71:      --  −32,    0, −32,
F72:      --}
F73:      fullsharp =       --full sharpen filter
F74:      {
F75:         xsize=3,ysize=3,
F76:        −16,    0,  −16,
F77:          0,   64,    0,
F78:        −16,    0,  −16
F79:      }
F80:
F81:      xfullsharp =       --full sharpen filter, times 2
F82:      {
F83:         xsize=3,ysize=3,
F84:        −32,    0, −32,
F85:          0, 128,    0,
F86:        −32,    0, −32,
F87:      }
F88:
F89:      Ortho =       --Filter to detect any orthogonal flags on
F90:      {
F91:         xsize=3,ysize=3,
F92:          0,  1,  0,
F93:          1,  1,  1,
F94:          0,  1,  0
F95:      }
F96:
F97:      boxflt =    --box filter for diagonal lines
F98:      {
F99:         xsize=3,ysize=1,
F100:        0,128,128
F101:}
F102:Ltcorner =    --Filter to detect center flag on
F103:{
F104:        xsize=3,ysize=3,
F105:          1,  0,  0,
F106:          0,  0,  0,
F107:          0,  0,  0
F108:}
F109:     Lbcorner =    --Filter to detect center flag on
F110:{
F111:        xsize=3,ysize=3,
F112:          0,  0,  0,
F113:          0,  0,  0,
F114:          1,  0,  0
F115:}
F116:     Rtcorner =    --Filter to detect center flag on
F117:{
F118:        xsize=3,ysize=3,
F119:          0,  0,  1,
F120:          0,  0,  0,
F121:          0,  0,  0
F122:}
F123:     Rbcorner =    --Filter to detect center flag on
F124:{
F125:        xsize=3,ysize=3,
F126:          0,  0,  0,
F127:          0,  0,  0,
F128:          0,  0,  1
F129:}
Spr1:                    --*******************************
Spr2:function dospr(x,y) --routine to do the SPR filtering
Spr3:        local lft,rgt,ext          --values during SPR
Spr4:        local R,G,B,W,L = 0,1,2,3,4 --give names to the
    locations in the GMA buffer
Spr5:        local evenodd =
    spr.bxor(spr.band(x+HS,1),spr.band(y+VS,1) ,FLIP_UP,
    FLIP_LEFT) --checkerboard position
Spr6:        local ortho=spr.sample("sinv",x,y,0,Ortho) --0 if no
    sat bits
Spr7:
Spr8:        if evenodd==0 then--RG logical pixel
Spr9:           local meta    = spr.sample(pipeline,x,
    y,L,metasharp) --meta is the same for R and G
Spr10:               local redss    = spr.sample(pipeline,x,
    y,R,fullsharp)
Spr11:               local grnss    = spr.sample(pipeline,x,
    y,G,fullsharp)
Spr12:               local redbx    = spr.sample(pipeline,x,
    y,R,boxflt)
Spr13:               local grnbx    = spr.sample(pipeline,x,
    y,G,boxflt)
Spr14:               local bluss    = spr.sample(pipeline,x,
    y,B,fullsharp) --blue self sharp result
Spr15:               local blubx    = spr.sample(pipeline,x,
    y,B,boxflt)
Spr16:               local blueshift = 1−2*FLIP_LEFT--flip left
    reverses direction of blue shift
Spr17:               lft = spr.sample(pipeline,x,    y,R,diamond)
          --red subpixel
Spr18:               rgt = spr.sample(pipeline,x,    y,G,diamond)
          --green subpixel
Spr19:                 ext = spr.sample(pipeline,x,    y,B,diamond)
          --blue subpixel
Spr20:
Spr21:                    if ortho_mod==1 then
Spr22:                       --ortho override
Spr23:                       local
    ltcorner=spr.sample("sinv",x,y,0,Ltcorner)    --0 if no
    sat bits in the left top corner neighbor
```

TABLE 1-continued

SPR, LUA CODE

```
Spr24:                    local
      lbcorner=spr.sample("sinv",x,y,0,Lbcorner)    --0 if no
      sat bits in the left bottome corner neighbor
Spr25:                    local
      rtcorner=spr.sample("sinv",x,y,0,Rtcorner)    --0 if no
      sat bits in the right top corner neighbor
Spr26:                    local
      rbcorner=spr.sample("sinv",x,y,0,Rbcorner) --0 if no
      sat bits in the right bottom corner neighbor
Spr27:
Spr28:                        if (ltcorner==1 and lbcorner==1)
      or (rtcorner==1 and rbcorner==1) or
Spr29:                            (ltcorner==1 and rtcorner==1)
      or (lbcorner==1 and rbcorner==1) then
Spr30:                            ortho=1   --ortho override
Spr31:                        end
Spr32:                    end
Spr33:
Spr34:                if ortho==0 then          --if no saturated
      colors near by
Spr35:                  lft = lft + meta    --then use meta luma
      filtering
Spr36:                  rgt = rgt + meta
Spr37:                    ext = ext + meta
Spr38:                else
Spr39:                  local
      diag=spr.bor(dplane(x,y,R),dplane(x,y,G))          --or
      red and green tests together
Spr40:                  if diag==1 then          --if in saturated
      areas and near diagonals
Spr41:                    lft = redbx              --then use box
      filter
Spr42:                      rgt = grnbx
Spr43:                  else                --else use self color
      sharpening
Spr44:                    lft = lft + redss
Spr45:                    rgt = rgt + grnss
Spr46:                  end
Spr47:                    local bdiag=dplane(x,y,B)
Spr48:                    if bdiag==1 then       --for compatibility
      with old code, test blue separately
Spr49:                      ext = blubx
Spr50:                  else                --else use self color
      sharpening
Spr51:                      ext = ext + bluss
Spr52:                  end
Spr53:                end                         --end MIX_BOB diagonal
      stuff
Spr54:            else                      --BW logical pixels
Spr55:                                    --Blue subpixel
      ************************************
Spr56:                local blueshift = 1-2*FLIP_LEFT--flip left
      reverses direction of blue shift
Spr57:                local bluss = spr.sample(pipeline,x-
      blueshift,y,B,fullsharp)        --blue self sharp result
Spr58:                local blums = spr.sample(pipeline,x-
      blueshift,y,L,metasharp)        --blue meta sharp result
Spr59:                local bortho= spr.sample("sinv",    x-
      blueshift,y,0,Ortho)            --0 if no sat bits
Spr60:                local blubx = spr.sample(pipeline,x-
      blueshift,y,B,boxflt)
Spr61:                                --white subpixel
      ************************************
Spr62:                local whtss = spr.sample(pipeline,x,
      y,W,fullsharp)    --white self sharp
Spr63:                local whtms = spr.sample(pipeline,x,
      y,L,metasharp) --white meta sharp
Spr64:                local whtbx = spr.sample(pipeline,x,
      y,W,boxflt)
Spr65:                local doedge=0          --if ==1 then edge
      processing is necessary
Spr66:                lft = spr.sample(pipeline,x-
      blueshift,y,B,diamond)          --blue before
      sharpening
Spr67:                rgt = spr.sample(pipeline,x,
      y,W,diamond)                    --white before sharpening
Spr68:                  ext = 0
Spr69:                                --************************
```

TABLE 1-continued

SPR, LUA CODE

```
Spr70:                local diag=dplane(x-blueshift,y,B)
                --calculate blue diagonal test bit at the last
      second
Spr71:                  if ortho_mod==1 then
Spr72:                    --ortho override
Spr73:                    local
      ltcorner=spr.sample("sinv",x,y,0,Ltcorner) --0 if no
      sat bits in the left top corner
Spr74:                    local
      lbcorner=spr.sample("sinv",x,y,0,Lbcorner) --0 if no
      sat bits in the left bottome corner
Spr75:                    local
      rtcorner=spr.sample("sinv",x,y,0,Rtcorner) --0 if no
      sat bits in the right top corner
Spr76:                    local
      rbcorner=spr.sample("sinv",x,y,0,Rbcorner) --0 if no
      sat bits in the right bottom corner
Spr77:
Spr78:                        if (ltcorner==1 and lbcorner==1)
      or (rtcorner==1 and rbcorner==1) or
Spr79:                            (ltcorner==1 and rtcorner==1)
      or (lbcorner==1 and rbcorner==1) then
Spr80:                            ortho=1 --ortho override
Spr81:                        end
Spr82:
Spr83:                    --bortho override
Spr84:                    local ltbcorner=spr.sample("sinv",x-
      blueshift,y,0,Ltcorner) --0 if no sat bits in the
      blueshifted lt corner
Spr85:                    local lbbcorner=spr.sample("sinv",x-
      blueshift,y,0,Lbcorner) --0 if no sat bits in the
      blueshifted lb corner
Spr86:                    local rtbcorner=spr.sample("sinv",x-
      blueshift,y,0,Rtcorner) --0 if no sat bits in the
      blueshifted rt corner
Spr87:                    local rbbcorner=spr.sample("sinv",x-
      blueshift,y,0,Rbcorner) --0 if no sat bits in the
      blueshifted rb corner
Spr88:
Spr89:                        if (ltbcorner==1 and
      lbbcorner==1) or (rtbcorner==1 and rbbcorner==1) or
Spr90:                            (ltbcorner==1 and
      rtbcorner==1) or (lbbcorner==1 and rbbcorner==1) then
Spr91:                            bortho=1 --bortho override
Spr92:                        end
Spr93:                    end
Spr94:
Spr95:                    --blue subpixel uses different offset
Spr96:              if bortho==0 then          --if no saturated
      pixels nearby
Spr97:                lft = lft + blums--use meta-luma
      sharpening
Spr98:                  doedge=1
Spr99:              else                --if near saturated pixels
Spr100:               if diag==1 then          --new way to do blue
Spr101:                 lft = blubx
Spr102:               else
Spr103:                 lft = lft + bluss       --use self
      sharpening
Spr104:                 doedge=1
Spr105:               end
Spr106:             end
Spr107:                                --white subpixel
Spr108:             if ortho==0 then          --if no saturated
      pixels nearby
Spr109:               rgt = rgt + whtms--use meta-luma
      sharpening
Spr110:             else              --if near saturated pixels
Spr111:               local diag=dplane(x,y,W)
Spr112:               if diag==1 then          --and near a
      diagonal line
Spr113:               rgt = whtbx              --then use a box
      filter
Spr114:             else
Spr115:               rgt = rgt + whtss        --else use self
      sharpening
Spr116:             end
Spr117:             end
```

TABLE 1-continued

SPR, LUA CODE

```
Spr118:                                --*************************
Spr119:
Spr120:            if EDGE==1 and doedge==1 then --EDGE
        processing for mixed saturation
Spr121:                local r2,g2,blue_sh =
        spr.fetch(pipeline,x-blueshift,y)
Spr122:                local r3,g3,blue_nosh =
        spr.fetch(pipeline,x,y)
Spr123:                local edgelogic = false
Spr124:                  if NSE==0 then    --Original with edge
        processing only on edges of the screen
Spr125:                    edgelogic=
Spr126:                    (((x+HS)==1)          and (FLIP_LEFT==0)
        and (blue_sh>=blue_nosh)) or
Spr127:                    (((x+HS)==0)          and (FLIP_LEFT==1)
        and (blue_sh<=blue_nosh)) or
Spr128:                    (((x+HS)==(fxsiz-1)) and (FLIP_LEFT==0)
        and (blue_nosh>=blue_sh)) or
Spr129:                    (((x+HS)==(fxsiz-2)) and (FLIP_LEFT==1)
        and (blue_nosh<=blue_sh))
Spr130:                elseif NSE==1 then --Edge processing on
        right on edge of screen only
Spr131:                  edgelogic=
Spr132:                    (((x+HS)==(fxsiz-1)) and (FLIP_LEFT==0)
        and (blue_nosh>=blue_sh)) or
Spr133:                    (((x+HS)==(fxsiz-2)) and (FLIP_LEFT==1)
        and (blue_nosh<=blue_sh))
Spr134:
Spr135:                end
Spr136:            if edgelogic then
Spr137:                lft = spr.sample(pipeline,x,y,B,diamond) +
        spr.sample(pipeline,x,y,B,fullsharp)
Spr138:                rgt = spr.sample(pipeline,x,y,W,diamond) +
        spr.sample(pipeline,x,y,W,fullsharp)
Spr139:            end
Spr140:        end        --edge processing
Spr141:      end --BW logical pixel
Spr142:
Spr143:      lft = math.floor((lft+128)/256)    --filters are
        times 256
Spr144:      rgt = math.floor((rgt+128)/256)
Spr145:      ext = math.floor((ext+128)/256)
Spr146:
Spr147:      lft = math.max(0,lft)       --sharpening filters can
        cause overflow or underflow
Spr148:      rgt = math.max(0,rgt)    --we've got to clamp it
        to the maximum range
Spr149:      ext = math.max(0,ext)
Spr150:      lft = math.min(MAXOOG,lft)
Spr151:      rgt = math.min(MAXOOG,rgt)
Spr152:      ext = math.min(MAXOOG,ext)
Spr153:
Spr154:      if evenodd==1 then          --if this is a BW
        pair,
Spr155:        rgt = math.min(rgt,MAXCOL)       --white must be
        limited to 11 bits
Spr156:      end
Spr157:
Spr158:      if FLIP_LEFT==1 then
Spr159:        lft,rgt = rgt,lft       --this works in Lua! Swap
        two values!
Spr160:      end
Spr161:
Spr162:      spr.store(frameB,x,y,lft,rgt,ext)
Spr163:    end    --function dospr
```

END OF TABLE 1

Notes on the code in Table 1:

Note 1: brute force software implementation of blackjack type tests; requires a separate frame buffer named bin with pixels; thresholded to 0 or 1 already; returns 1 if pattern match or inversion of pattern match; hardware implements this with 9-bit bit-pattern tests.

Note 2: the test is performed for all patterns D1-D15. The code for the remaining patterns is omitted.

TABLE 2

SPR, PSEUDOCODE

```
PS1.   RG pair:
PS2.   If saturated bit in diagonal corners, then
  ortho=1.
PS3.   If ortho=0, then Rw, Gw = diamond+meta,
  Ext=diamond+meta
PS4.   If ortho=1 then
PS5.       If diag in R and G planes, then
               Rw, Gw=box filter
PS6.       Else Rw, Gw=diamond plus DOG.
PS7.       If bdiag (diag in B plane), then
               ext=box filter
               else ext=diamond plus DOG
PS8.   BW pair:
PS9.   If sat bit in diagonal corners, then ortho=1.
PS10.  If sat bit in blue-shifted diagonal corners, then
  bortho=1.
PS11.  If bortho=0, then Bw=diamond+meta with blue shift,
           doedge=1
PS12.  Else:
PS13.      If diagonal in B plane with blue shift then
               Bw= box (with blue shift)
PS14.      Else Bw=diamond+DOG with blue shift,
  doedge=1.
PS15.  If ortho=0, then Ww=diamond+meta
PS16.  Else:
PS17.  If diagonal in W plane then
           Ww= box
PS18.      Else Ww=diamond+DOG
PS19.  If edge processing conditions hold, then
           Bw,Ww=diamond+DOG without blue shift
PS20.  End of BW pair.
PS21.  Clamping
```

END OF TABLE 2

Scaling and Gamut Clamping

As stated above, at steps 444 (Scaler) and 450 (Gamut clamp) of FIG. 6, some embodiments check for "black holes" (i.e. features like in FIG. 7A section II), and perform additional reduction of the subpixel values inside black holes ("on diagonal D"). This helps restore local contrast.

The presence of a black hole depends on the backlight unit's output power BL. More particularly, the input rgb data are assumed to define the image when the backlight unit generates some output power $BL=BL_0$. As seen from equations (3), the R, G, and B subpixel values produced by the SPR block 454 are in the range of 0 to $(MAXCOL/M_0)$ inclusive. The W value Ww can be up to $MAXCOL/M_1$, but it is typically chosen not to exceed max(r,g,b) and thus not to exceed MAXCOL. Therefore, Ww does not exceed $MAXCOL/M_0$. The RwGwBwWw values produced by the SPR block 454 define the desired subpixel luminances when the backlight unit's output power is $BL_0$. However, to provide a value input to display 110, the subpixel values must not exceed MAXCOL. If the subpixel values are multiplied by $M_0$ to fit into the range of 0 to MAXCOL inclusive, then the backlight unit's output power $BL_0$ needs to be divided by $M_0$, i.e. to be set to $$BL=BL_0/M_0.$$

In fact, a smaller BL value may suffice if the maximum subpixel value $P_{max}$=max(Rw,Gw,Bw,Ww) is below $MAXCOL/M_0$. More particularly, given the maximum value $P_{max}$, the minimum BL value $BL_{min}$ sufficient to display all the subpixels without distortion is $$BL_{min}=BL_0*P_{max}/\mathrm{MAXCOL}.$$

It may be desirable to set the output power BL to a value below $BL_{min}$. In any case, it is sometimes convenient to express the output power BL as a percentage of $BL_0$, i.e.

$$BL=(1/INVy)*BL_0$$

where INVy is the coefficient by which the subpixel values corresponding to $BL_0$ need to be multiplied (in scaler 444) to correspond to BL. For example, if $BL=BL_{min}$, then $INVy=MAXCOL/P_{max}$. If $BL=BL_0$, then INVy=1.

If BL is below $BL_{min}$ (i.e. $INVy>MAXCOL/P_{max}$), then some subpixel values can be above MAXCOL, so scaling/gamut clamping may be needed. Some methods for determining BL in block 430 are described below in Addendum B.

Figure 9:
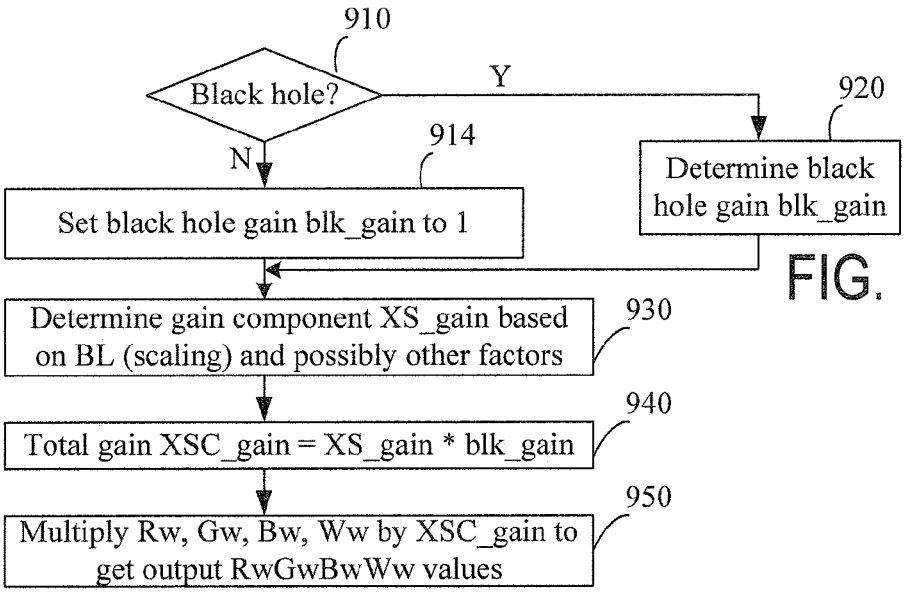
FIG. 9 is a flow chart of gamut clamping according to some embodiments of the present invention.

FIG. 9 illustrates an exemplary flowchart for steps 444, 450 (scaling/gamut clamping) of FIG. 6. FIG. 9 shows processing of a quad 1010 (FIG. 10) consisting of two adjacent subpixel pairs $\mathbf{124}_{x,y}$ and $\mathbf{124}_{x+1,y}$ in one row. One pair is RG, and the other pair is BW.

FIG. 9 is described in more detail below. Briefly, a multiplicative gain factor XSC_gain is calculated at step 940 as a value between 0 and 1 inclusive, and at step 950 the RwGwBwWw subpixel values in quad 1010 are multiplied by this gain factor to bring the colors into gamut without changing the hue and saturation. The gain XSC_gain is a product of a "normal" gain XS_gain and a "black hole" gain blk_gain. See step 940. The normal gain XS_gain depends on BL so as not to exceed INVy (to implement the scaler 444). If the quad 1010 is in a black hole (as is checked at step 910), then the black hole gain blk_gain may be below 1. Otherwise the black hole gain is set to 1.

Now suppose that quad 1010 corresponds to two adjacent pixels on diagonals D, B (FIGS. 5, 7A) in the same row. Then quad 1020 corresponds to diagonals A, AA, and quad 1030 corresponds to diagonal BB and the next diagonal to the right. The maximum subpixel value in quad 1010 in section II of FIG. 7A will be in a black hole. Therefore, blk_gain will likely be below 1, and hence XSC_gain will be reduced by blk_gain.

When the pixels on diagonals AA, A are processed (i.e. when quad 1010 corresponds to two pixels on diagonals AA, A), then blk_gain will be 1 because the pixels on diagonals AA, A are not in a black hole. However, in some embodiments described below, the normal gain XS_gain is a decreasing function of the maximum rgb coordinate (see equation (3)) of the two pixels. Therefore, XS_gain for diagonals AA, A could be lower than for diagonals D, B. This would result in a loss of contrast if the black hole gain were not used. Setting the black hole gain to a value below 1 for diagonals D, B acts to reduce the subpixel values for these two diagonals to regain contrast loss.

Table 3 below illustrates simulation code for a procedure "dopost" which simulates the method of FIG. 9. The simulation code is written in LUA. The processing uses integer arithmetic (fixed-point arithmetic) with the gain factors XS_gain, blk_gain being later divided by 256. The method of FIG. 9 is performed once for each quad. Thus, x is incremented by two in each iteration of the method of FIG. 9, and y is incremented by 1. In an actual implementation, all quads can be processed in parallel or in some other sequence.

Figure 10:
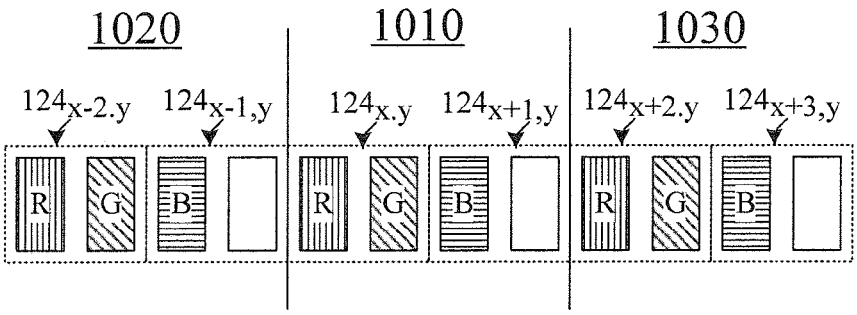
FIG. 10 is a front view of a portion of a display device of FIG. 3 to illustrate some aspects of the gamut clamping operation of FIG. 9.

FIG. 10 shows a subpixel quad 1020 on the immediate left of quad 1010 and another quad 1030 on the immediate right of quad 1010. The embodiment of Table 3 is simplified in that when checking for the black hole (step 910 of FIG. 9), the embodiment checks for out-of-gamut colors only in the adjacent quads 1020, 1030. The embodiment does not check the quads above and below the quad 1010. This is a simpler implementation which allows one to reduce the cost of circuit 320. Other embodiments may check the quads above and/or below.

Step 910 is implemented in lines Sc46-Sc61 in Table 3. The initial (pre-clamping) subpixel values for quad 1010 are denoted Rw, Gw, Bw, Ww. The test of step 910 is as follows: If max (Rw,Bw,Gw,Ww) does not exceed MAXCOL in quad 1010 and the maximum subpixel value in each of quads 1020, 1030 exceeds MAXCOL, then the black hole is detected. Other tests can also be used. For example, a black hole may include an additional requirement that the maximum subpixel value in each of quads 1020, 1030 exceed MAXCOL by some factor (e.g. is at least 1.1*MAXCOL), and/or exceeds the maximum subpixel value in quad 1010 by some factor. Further, the test may check for the luminances in quads 1020, 1030 to be above the luminance in quad 1010 or above some value, or for the luminance in quad 1010 to be below some value. Other tests may also be used.

Of note, in this embodiment, the test does not depend on INVy. Thus, even if $INVy=M_0$, a black hole is detected and blk_gain may be set to a value below 1. As is seen by comparing the sections I and II of FIG. 7A, the local contrast is reduced on diagonal D even if $INVy=M_0$, and setting blk_gain to a value below 1 helps restore the local contrast. In other embodiments, the test depends on INVy, e.g. the test can be performed by comparing the subpixel values times INVy with MAXCOL.

If the test fails (i.e. no black hole is detected), then blk_gain is set to 1 (step 914 in FIG. 9; line Sc4 in Table 3). Of note, the value 256 in line Sc4 corresponds to 1 because the black gain is later divided by 256.

If the test passes, then (see step 920 of FIG. 9) blk_gain is calculated as an 8-bit value in lines Sc62-Sc64 of Table 3 as:

$$\text{blk_gain}=2*\text{MAXCOL}-1-(\text{maximum subpixel value in quads 1020, 1030}) \quad (9)$$

In this example, MAXCOL=2047, and $M_0=M_1=½$. GAMBITS=11 in line Sc61. Alternatively, the following equation can be used:

$$\text{blk_gain}=\text{ceiling}[1/M_0*\text{MAXCOL}]-1-(\text{maximum subpixel value in quads 1020, 1030})$$

Then (line Sc65) blk_gain is increased by Ww/16. If the Ww value is large (i.e. the black hole is actually a white hole), then the black hole gain is increased by this operation. Then blk_gain is hard-clamped to the maximum value of 256 (i.e. to 1 after division by 256 in line Sc111).

At step 930, the "normal" gain XS_gain is determined as shown in lines Sc72-Sc109. The invention is not limited to a particular way of determining XS_gain. In some other embodiments, the normal gain is not used (or, equivalently, is set to 1). Some gamut clamping examples suitable for XS_gain determination are given in U.S. patent application published as no. 2007/0279372 A1 published on Dec. 6, 2007, filed by Brown Elliott et al., entitled "MULTIPRIMARY COLOR DISPLAY WITH DYNAMIC GAMUT MAPPING", incorporated herein by reference.

In the particular example of Table 3, XS_gain depends on the saturation and the maximum of the r, g, b values which are defined as in equations (3). More particularly, as shown in line Sc91 of Table 2, XS_gain is calculated as the sum of the saturation-based gain sat_gain and a value "nl_off". The sum is hard-clamped to the maximum value of INVy received from block 430.

The value sat_gain is determined in lines Sc72-Sc84 as a value between some predefined parameters GMIN and GMAX inclusive. In some embodiments, GMAX=1 (i.e. 256 before division by 256) and GMIN=½. The value sat_gain is a function of saturation, and more particularly of the saturation inverse sin v defined as follows:

$$\sin v = Ww/\max(1, Rw, Gw, Bw)$$

See lines Sc74-Sc83. If the saturation is at most some predefined threshold value (e.g. 50%), i.e. if sin v at least some threshold, then sat_gain is set to about GMAX. In line Sc84, the threshold is defined by REG_SLOPE (REG_SLOPE is an integer value corresponding to 1). If sin v is zero, then sat_gain is set to about GMIN. If sin v is between zero and its threshold, then sat_gain is obtained as a linear interpolation function equal to about GMIN at sin v=0 and to about GMAX at the threshold value. In addition, sat_gain is hard-clamped to the maximum value of 1 (to 256 in line Sc85).

The term nl_off ("non-linear offset") is calculated in lines Sc87-Sc90 based on max(r,g,b) where r, g, b are as in (3). Equations (3) indicate that $\max(r,g,b)=M_0*\max(R,G,B)+M_1*W$. It is assumed for simplicity in Table 3 that the RGBW values are the subpixel values Rw, Gw, Bw, Ww. The value nl_off is calculated as a linear interpolation function equal to 0 when max(r,g,b)=MAXCOL, and equal to about N*INVy when max(r,g,b)=0, where N is a predefined parameter between 0 and 256 inclusive.

As stated above, XS_gain is the sum of sat_gain and nl_gain hard-clamped to INVy. The value XS_gain is then further adjusted to ensure that after being multiplied by XS_gain, the subpixel values Rw, Gw, Bw, Ww do not exceed MAXCOL (lines Sc97-Sc109).

Step 940 is performed at line Sc111.

At step 950, the Rw, Gw, Bw, Ww values are multiplied by XSC_gain (lines Sc115-Sc119).

Then, at lines Sc122-Sc128, the Ww value can be further adjusted so that the dopost process would not change the luminance of the quad 1010. More particularly, the luminance Lw can be calculated before and after the scaling and gamut clamping as:

$$Lw=(2*Rw+5*Gw+B2+8*Ww)/16 \text{ (see lines } Sc44, Sc19).$$

The Ww value can be adjusted so that the post-scaling and pre-scaling luminances coincide.

Finally, the values Rw, Gw, Bw, Ww are hard-clamped to the range of 0 to MAXCOL inclusive (lines Sc129-Sc137).

TABLE 3

Scaling and Gamut Clamping

```
Sc1:  local Rw,Gw,Bw,Ww   --static variables to survive
      successive calls to dopost
Sc2:  -- *******dopost does saturation-scaling, variable-
      scaling and gamut clamping
Sc3:  function dopost(x,y)
Sc4:     local blk__gain=256       --I start by calculating black
      hole gain
Sc5:     local scale__clamp = 0          --flag indicating
      clamping was done
Sc6:     rd,gd,bd = 0,0,0            --for a diagnostic image
Sc7:
Sc8:  if y==78 and x==25 then
Sc9:     glob=1
Sc10:end
Sc11:                                --Post scaling works in groups of 4, so
      I always read 2 logical pixels
Sc12:
Sc13:    local evenodd =
      spr.bxor(spr.band(x,1),spr.band(y,1),FLIP__UP,FLIP__LEFT)
            --checkerboard position
Sc14:       if FLIP__LEFT==0 then                --if SID==0 or 2
Sc15:          if evenodd==0 then
```

TABLE 3-continued

Scaling and Gamut Clamping

```
Sc16:          Rw,Gw =spr.fetch(pipeline,x,y)          --fetch the
      values after frame buffer
Sc17:          if x==xsiz−1 then                       --if this is
      the last RG in a line
Sc18:             Bw,Ww=0,0                            --the BW will
      never come, run one more clock
Sc19:          else
Sc20:             return                               --else wait for
      the BW to arrive
Sc21:          end
Sc22:       else
Sc23:         Bw,Ww =spr.fetch(pipeline,x,y)           --fetch the
      values after frame buffer
Sc24:          if x==0 then                            --if this is
      the first BW in a line
Sc25:             Rw,Gw=0,0                            --there was no
      RG to go with this one, set them to zero
Sc26:          end                                          --and
      process this data anyway
Sc27:       end
Sc28:    else      --else SID==1 or 3
Sc29:       if evenodd==0 then
Sc30:          Gw,Rw = spr.fetch(pipeline,x,y)
Sc31:          if x==0 then
Sc32:             Ww,Bw=0,0    --on first GR, force WB to zero
Sc33:          end
Sc34:       else
Sc35:          Ww,Bw = spr.fetch(pipeline,x,y)
Sc36:          if x==xsiz−1 then    --on the last WB,
Sc37:             Gw,Rw = 0,0      --there will be no more GR's,
      clock one more timee
Sc38:          else
Sc39:             return              --not last one, wait for GR to
      arrive
Sc40:          end
Sc41:       end
Sc42:    end
Sc43:                        --I need to approximate luminance and
      saturation from the post-SPR data
Sc44:    local Lw=math.floor((2*Rw+5*Gw+Bw+8*Ww)/16)
Sc45:
Sc46:    if BEE == 1 then --black line enhancement
Sc47:          if DEBUG__IMAGE then
Sc48:             spr.store("BEE",x,y,0,0,128)
Sc49:             spr.store("BEE",x−1,y,0,0,128)
Sc50:          end
Sc51:       local r,g=spr.fetch(pipeline,x−3,y)          --fetch RGBW on
      left
Sc52:       local b,w=spr.fetch(pipeline,x−2,y)
Sc53:       local rgbw1=spr.bor(r,g,b,w)                 --only upper
      bits ored together matter
Sc54:       local oog=math.max(r,g,b,w)
Sc55:    r,g=spr.fetch(pipeline,x+1,y)                   --RGBW to the
      right
Sc56:       b,w=spr.fetch(pipeline,x+2,y)
Sc57:       local rgbw3=spr.bor(r,g,b,w)
Sc58:       oog = math.max(oog,r,g,b,w)
Sc59:       local rgbw2=spr.bor(Rw,Gw,Bw,Ww)
Sc60:       if   (rgbw2<=MAXCOL) and
            --(Ww < (MAXCOL+1)/16) and
      --if center is in-gamut AND SATURATED (ignore white
      holes)
Sc61:          ((rgbw1>MAXCOL) and (rgbw3>MAXCOL)) then --
      surrounded by OOG
Sc62:          oog =
      math.floor(spr.band(oog,MAXCOL)/(2^(GAMBITS−7))) --
      discard OOG bit and save next 7 bits
Sc63:          oog = (127−oog)+128--invert and set bit 8
Sc64:          blk__gain = oog       --lower gain value to darken
      this pixel
Sc65:    blk__gain = math.min(256, (blk__gain +
      math.floor(Ww/16)) )--feather in a "white hole ignore"
Sc66:          if DEBUG__IMAGE then
Sc67:        spr.store("BEE",x,y,blk__gain,blk__gain,blk__gain)
Sc68:             spr.store("BEE",x−
      1,y,blk__gain,blk__gain,blk__gain)
Sc69:          end
Sc70:       end
```

TABLE 3-continued

Scaling and Gamut Clamping

```
Sc71:    end              --end black hole detector
Sc72:                     --Perform saturation-scale gain calc
Sc73:    local gmin=GMIN+1          --default to fixed GMIN
Sc74:    local max_rgb = math.floor( ( math.floor(M0_reg/256
         * math.max(Rw,Gw,Bw) * 2) + math.floor(M1_reg/256 * Ww
         * 2)    )/2)
Sc75:                     -- 12bit term + 11bit term will produce 13
         bit result then divide by 2 to get 12 bit result
Sc76:                     -- then clamp to MAXCOL to get 11 bit result
         (prevent overflow from cross-pollinated pixel pairs)
Sc77:    max_rgb = math.min(MAXCOL, max_rgb)
Sc78:    max_rgb = math.max(1, max_rgb)                -- prevent
         divide by zero
Sc79:    local inv_max_rgb_lut =
         math.floor((plus4bit/max_rgb)+0.5)            --LUT in
         hardware versions
Sc80:    local min_rgb = math.floor( ( math.floor(M0_reg/256 *
         math.min(Rw,Gw,Bw) * 2) + math.floor(M1_reg/256 * Ww *
         2)    )/2)
Sc81:                     -- 12bit term + 11bit term will produce 13
         bit result then divide by 2 to get 12 bit result
Sc82:    min_rgb = math.min(MAXCOL, min_rgb) -- then clamp to
         MAXCOL to get 11 bit result (prevent overflow from
         cross-pollenated pixel pairs)
Sc83:    local sinv = math.floor(inv_max_rgb_lut*min_rgb)
8c84:    local sat_gain =
         math.floor(REG_SLOPE*sinv/plus4bit+gmin)
Sc85:    sat_gain = math.min(256,sat_gain,GMAX+1)
Sc86:
8c87:                     --calculate non-linear gain term, translated to
         RwGwBwWw space
Sc88:    local nl_index_11bits = max_rgb
Sc89:
Sc90:    local nl_off = math.floor((N*16+16)*INVy/256*(MAXCOL−
         nl_index_11bits)/(MAXCOL+1))
Sc91:    local nl_gain=math.min(INVy, sat_gain+nl_off)
Sc92:    gd = OutGamma((256−sat_gain)*MAXCOL*2/256) --
         diagnostic, paint sat gain green
Sc93:
Sc94:    XS_gain = nl_gain --save this for clamp gain
         calculation
Sc95:
Sc96:                     --always calculte the Gamut Clamp gain and
         use that if other algorithms leave a color OOG
Sc97:        local maxp = math.max(Rw,Gw,Bw,Ww)        --find the
         maximum primary
Sc98:    maxp = math.floor(maxp*XS_gain/256)            --predict
         how far OOG after sat and X/XL
Sc99:    local clamp_gain=256                           --default to
         1.0, no clamping
Sc100:             if maxp>MAXCOL then                  --if this
         color would go OOG
Sc101:                 local Ow = spr.band(maxp,MAXCOL)        --
         calc distance OOG, used for LUT index
Sc102:                 clamp_gain =
         math.floor((256*(MAXCOL+1))/(maxp+1))    --results of the
         INV LUT for gamma clamping
Sc103:                 rd =
                       OutGamma((256−clamp_gain)*MAXCOL*2/256)
Sc104:                 if clamp_gain<256 then
Sc105:                    scale_clamp=1                 --if gain is still
         needed, set flag bit
Sc106:                 end
Sc107:             end -- out of gamut color
Sc108:
Sc109:             XSC_gain = math.floor(XS_gain*clamp_gain/256)
                --combine X/XL, sat and clamping to one constant
Sc110:
Sc111:             XSC_gain = math.floor(XSC_gain*blk_gain/256)
                --and combine with black hole gain
Sc112:
Sc113:                     --the INVy X/Xl scaling value can be
         >1.0 so the scale value is 9bits now
Sc114:                     --with one bit above the binary point
         and 8 below.
Sc115:             Rw = math.floor((Rw * XSC_gain+ 128)/256) --
         12*9=12bit multiplication
Sc116:             Gw = math.floor((Gw * XSC_gain+ 128)/256) --
         (only need 12*9=11 but must test for
Sc117:             Bw = math.floor((Bw * XSC_gain+ 128)/256) --
         overflow and hard clamp to MAXCOL below)
Sc118:             Ww = math.floor((Ww * XSC_gain+ 128)/256) --
         clamp to black value for W
Sc119:             Lw = math.floor((Lw * XS_gain + 128)/256) --
         X/Xl processing alone for L
Sc120:
Sc121:                     --*********************************
Sc122:                     --CLAMP diagonal options
Sc123:             if CLE==1 and scale_clamp==1 then
Sc124:                 local Wl --calculate the W that produces the
         correct luminance
Sc125:                 Wl = math.floor((Lw*M1_inv−
         math.floor((2*Rw+5*Gw+Bw)*M2_inv/8))/32)
Sc126:                 Wl = math.min(Wl,MAXCOL)              --do not
                                                             exceed
         the max!
Sc127:                 Ww = math.floor((Wl*(2^(DIAG+4))+Ww*(128−
         (2^(DIAG+4))))/128) --mix the two together
Sc128:             end --clamp diag
Sc129:             Rw=math.min(Rw,MAXCOL)                --hard clamp
Sc130:             Gw=math.min(Gw,MAXCOL)                -- (happens
         if WR>1.0)
Sc131:             Bw=math.min(Bw,MAXCOL)                -- and from
         quantization error in LUTs.
Sc132:             Ww=math.min(Ww,MAXCOL)
Sc133:             Lw=math.min(Lw,MAXCOL)
Sc134:             Rw=math.max(Rw,0)                     --negative
         numbers (−1) in MIPI order
Sc135:             Gw=math.max(Gw,0)
Sc136:             Bw=math.max(Bw,0)
Sc137:             Ww=math.max(Ww,0)
Sc138:             Lw=math.max(Lw,0)
Sc139:
Sc140:             Ww = math.floor(Ww*(WG+1)/256)        --white
         gain can decrease white here
Sc141:
Sc142:             -- spr.store("post",x+odd,y,    Rw,Gw)        --store
         them in the post buffer
Sc143:             -- spr.store("post",x−odd+1,y,Bw,Ww)
Sc144:               if FLIP_LEFT==0 then
Sc145:                 if evenodd==0 then                  --only
         happens on the end of a line
Sc146:                     spr.store("post",x,y, Rw,Gw)--store just
         the RG
Sc147:                   else
Sc148:                     if x>0 then
Sc149:                        spr.store("post",x−1,y,Rw,Gw)        --store
         the RG when there is one
Sc150:                     end
Sc151:                     spr.store("post",x ,y,Bw,Ww) --and the BW
         every time
Sc152:                   end
Sc153:             else          --SID=1 or 3
Sc154:                 if evenodd==1 then --normally we only
         fall through on even pairs
Sc155:                     spr.store("post",x,y,Ww,Bw) --so this must
         be x==xsiz−1
Sc156:                   else
Sc157:                       if x>0 then
Sc158:                          spr.store("post",x−1,y,Ww,Bw)     --write
         the WB if there is one
Sc159:                       end
Sc160:                       spr.store("post",x,y,Gw,Rw)          --always
         write the GR
Sc161:             end
Sc162:         end
Sc163:     end      --function dopost
```

END OF TABLE 3

Bit Blit Update As explained above with reference to FIG. 6, in some embodiments the display apparatus may receive only a portion 1110 (FIG. 11) of the pixel data 104 because the remaining portion of the image is unchanged. The display apparatus performs a "bit blit" operation to update the changed portion of the image on the screen. The SPR operation 454 is not performed over the whole image. Other operations such as 444 (Scaler), 430 (BL computation), 450 (gamut clamp), and possibly others, may be performed over the whole image. The bit blit update reduces power consumption and also reduces the processing power required to update the image in a short period of time. Also, the bit blit update is convenient for mobile systems which receive images 104 over a low-bandwidth network link. Therefore, some embodiments are suitable for MIPI® (Mobile Industry Processor Interface). However, the invention is not limited to MIPI or mobile systems.

It will be assumed for ease of description that the new portion 1110 is rectangular. The invention is not limited to rectangular portions however.

In some other embodiments, the SPR operation is repeated over the whole image. More particularly, the display apparatus stores input data (rgb or RGBW) for each pixel of the image 104, and recalculates the pixel values in SPR operation 454 for the entire image when portion 1110 is received. The recalculation can be implemented as in FIG. 4 or 6. However, it is desirable not to repeat the SPR for at least some pixels in the unchanged portion of the image.

Some embodiments will now be described which are based on the SPR operation described above in connection with FIG. 8 and Table 1, but the invention is not limited to such embodiments.

Figure 11:
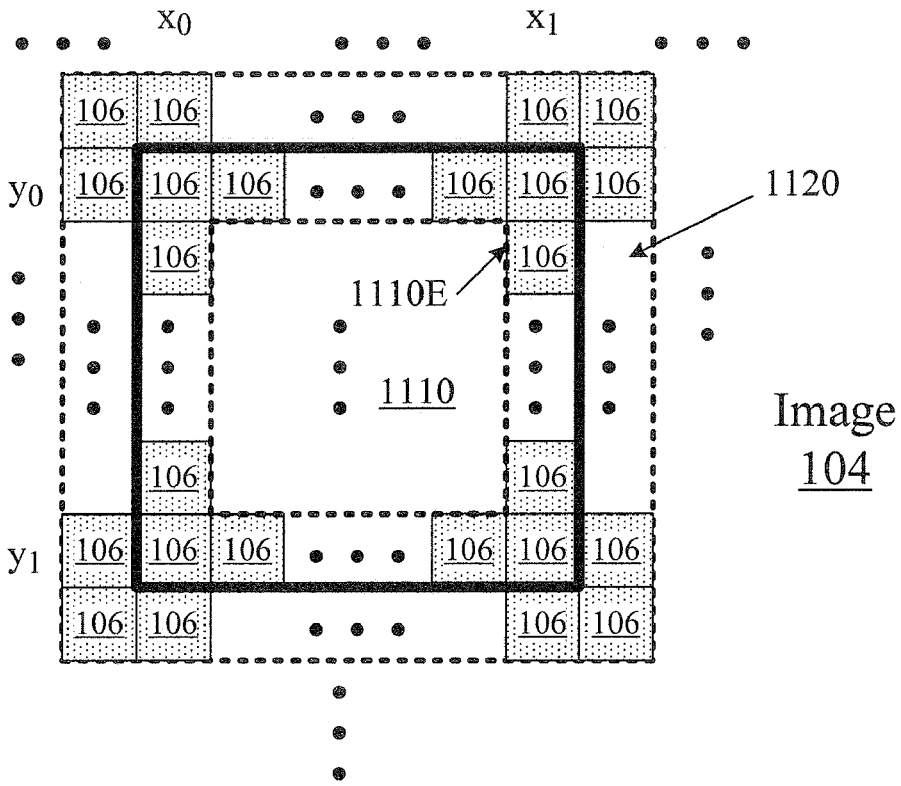
FIGS. 11-13 illustrates pixel areas in an update of an image portion.

In FIG. 11, the new portion 1110 includes an edge 1110E. The edge is one-pixel wide. The unchanged image portion includes a border area 1120 consisting of the pixels 106 bordering on the new portion 1110. Area 1120 is also one-pixel wide. When the SPR operation 454 is performed on the edge pixels 1110E, the SPR operation involves pixels 1120. However, some embodiments do not keep the rgb or RGBW data from the previous image. Therefore, such data are unavailable for pixels 1120. Processing of the edge pixels 1110E thus presents a special challenge, especially if the new image (defined by new portion 1110) is similar to the previous image. If the images are similar, then the viewer is more likely to notice the edge between the new portion 1110 and the surround. However, the invention is not limited to similar images.

In some embodiments, when performing the SPR operation 454 on the pixels 1110E, the pixels 1120 are replaced by mirror images of pixels 1110E. For example, suppose that the area 1110 is defined as $x_0 \leqq x \leqq x_1$ and $y_0 \leqq y \leqq y_1$ for some $x_0$, $x_1$, $y_0$, $y_1$. Then the border pixels 1120 are defined as follows for the SPR operation on the pixels 1110E:

$$106_{x_0-1,y}=106_{x_0,y};\quad 106_{x_1+1,y}=106_{x_1,y};\quad 106_{x-1,y_0}=106_{x-1,y_0}, \text{ and so on.}$$

The corner pixels are also mirrored:

$$106_{x_0-1,y_0-1}=106_{x_0,y_0}, \text{ etc.}$$

Further challenge is presented if the SPR uses a blue shift. The case of the left shift will be described in detail. The right-shift embodiments are similar.

Figure 12:
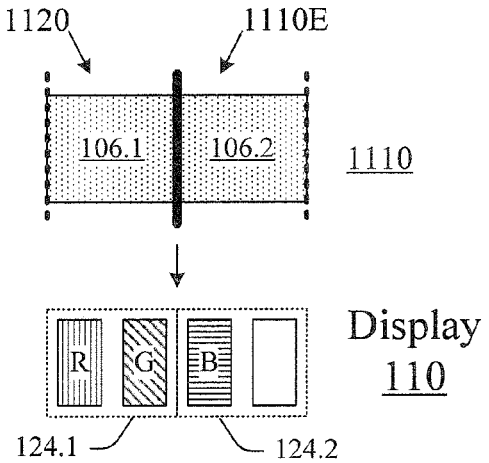

In the case of the left shift, if a pixel 106 in edge area 1110E at the left of portion 1110 is mapped into a BW pair, then the SPR filters may have to be applied to the adjacent pixel in border area 1120. In the example of FIG. 12, pixels 106.1, 106.2 are adjacent pixels in the same row in respective areas 1120, 1110E at the left of the new portion 1110. Pixel 106.1 is mapped into an RG pair 124.1, and pixel 106.2 is mapped into a BW pair 124.2. In the embodiment of Table 1, when rendering the blue subpixel of pair 124.2, the diamond filter (2) and the meta luma filter are applied to pixel 106.1. When the image is being updated with new portion 1110, pixel 106.1 is unchanged, and pixel 106.2 contributes with only a small weight in the two filters (e.g. the weight of ⅛ for the diamond filter). Therefore, in some embodiments, the SPR operation leaves the blue subpixel's value unchanged from the previous image in subpixel pair 124.2. More particularly, the SPR operation does not change the blue values (Bw) for the edge pixels 1110E mapped into the BW pairs and located at the left of the image. (The Bw values may of course be changed by subsequent operations such as in scaler 444 and gamut clamp 450.) In case of the right shift, the SPR operation does not change the blue values at the right edge of the image.

In some embodiments, if the new portion 1110 is one-column wide (and thus coincides with edge area 1110E), then all the Bw values corresponding to the new portion 1110 are unchanged.

Figure 13:
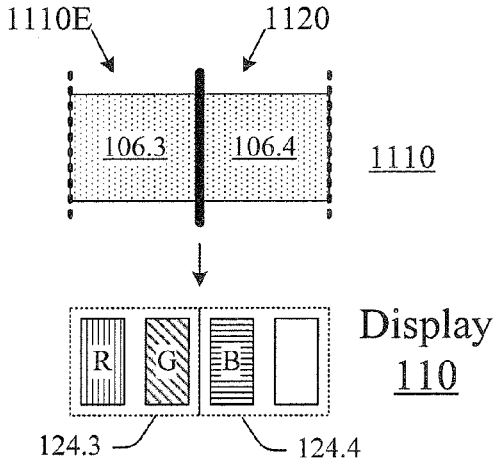

In the case of the left shift, another challenge is presented at the right edge when a border pixel 1120 is mapped into a BW pair. This is illustrated in FIG. 13. Adjacent pixels 106.3, 106.4 are in respective areas 1110E, 1120 at the right of the new portion 1110. Pixel 106.3 is mapped into an RG pair 124.3, and pixel 106.4 is mapped into a BW pair 124.4. Due to the blue shift, the blue pixel in pair 124.4 may have to be rendered by applying the SPR filters to pixel 106.3. Since pixel 106.3 is changed by new portion 1110, the frame buffer's location corresponding to the blue subpixel in pair 124.4 should be updated. It is desirable however to avoid writing the frame buffer's locations corresponding to the unchanged image portion, and generally to reduce the number of write accesses to frame buffer 610. Some embodiments achieve this goal by scrambling the subpixel values in frame buffer 610 so that the blue-subpixel locations store only least significant bits. The most significant bits are stored in the memory locations corresponding to the RG pairs. Therefore, if the memory locations corresponding to the blue subpixels (such as the blue subpixel in pair 124.4) are not updated, only the least significant bits are distorted.

Figure 14:
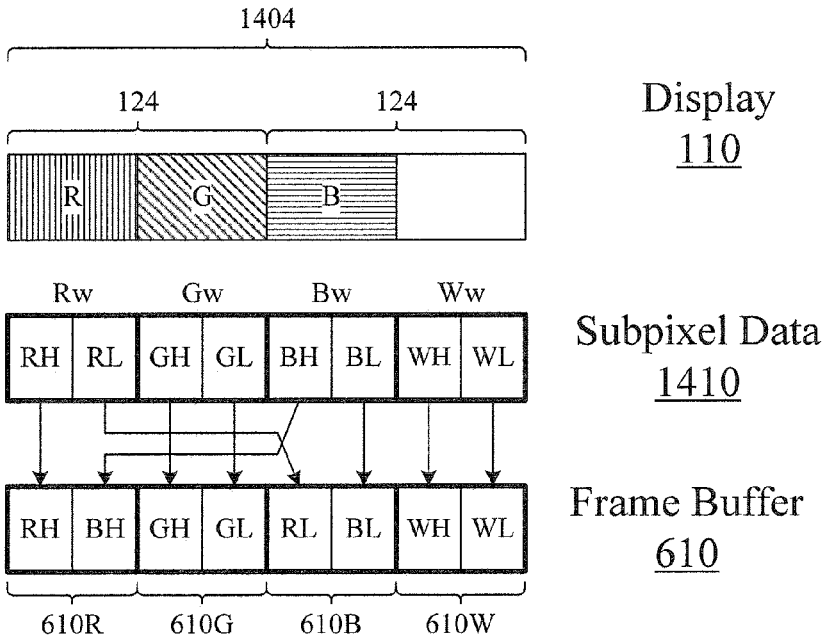
FIG. 14 illustrates pixels, subpixels, and arrangement of subpixel data in a frame buffer in some embodiments of the present invention.

FIG. 14 illustrates one example of the scrambling technique. The subpixels of display 110 are subdivided into quadruplets ("quads") 1404. Each quad 1404 contains two adjacent pairs $124_{x,y}$, $124_{x+1,y}$ in the same row. In each quad 1404, the left pair $124_{x,y}$ is an RG pair, and the right pair $124_{x+1,y}$ is a BW pair. The BW pairs at the left edge of the display and the RG pairs at the right edge are not part of any quad, and are handled as described below.

For each quad 1404, the SPR operation 454 provides subpixel values Rw, Gw, Bw, Ww shown at 1410. In FIG. 14, the most significant bit portion (MSB portion) of each value Rw, Gw, Bw, Ww is denoted respectively as RH, GH, BH, WH. The least significant bit portions (LSB portions) are denoted respectively as RL, GL, BL, WL. For example, in some embodiments, each value Rw, Gw, Bw, Ww is an 8-bit value, and the MSB and LSB portions are four bits each.

Each subpixel corresponds to a memory location in frame buffer 610. The memory locations may be independently addressable, but this is not necessary. In the example of FIG. 14, the memory locations for the red, green, blue and white subpixels of a quad 1404 are shown respectively as 610R, 610G, 610B, 610W. These can be consecutive memory locations (i.e. with consecutive addresses), but this is not necessary. In some embodiments, each memory location 610R, 610G, 610B, 610W consists of consecutive bits. The bits are consecutive in the address sense, not in the sense of the physical layout. Of note, the invention is not limited to independently addressable memory locations or to random access memories.

As indicated above, the contents of memory location 610B can be lost (not updated) if the image is updated with a new portion 1110 mapped into a subpixel area located immediately to the left of the BW pair $\mathbf{124}_{x+1,y}$. Therefore, in each quad, the memory location 610B stores only the least significant bits of some or all of the values Rw, Gw, Bw, Ww. In the embodiment of FIG. 14, the memory location 610B of each quad stores only the RL and BL values for the quad. The red and blue values are chosen because some experiments indicate that humans are less sensitive to the red and blue luminances than to the green and white luminances. The "red" location 610R stores the most significant bit portions RH, BH of the red and blue luminances. The green and white values Gw, Ww are stored in the respective locations 610G, 610W without scrambling. Other types of scrambling are possible.

Scrambling is performed when writing to frame buffer 610. When the frame buffer is read (e.g. by scaler 444 or block 430 in FIG. 6), the data are descrambled.

For each BW pair at the left edge of the screen (i.e. each BW pair $\mathbf{124}_{0,y}$), the MSB portion of the blue location 610B can be filled with a predefined value, e.g. 0. The BH value can be discarded. On descrambling, the BH value can be set to zero. The invention is not limited to this or other ways of handling the BW pairs at the edges.

For each RG pair at the right edge of the screen, in scrambling, the Bw value can be obtained by applying the suitable filters in the SPR operation to the pixel 106 corresponding to the RG pair. The BH portion of the Bw value can be written to the LSB portion of the location 610R. The BL and RL portions can be discarded. On descrambling, RL can be set to zero or some other value.

The invention is not limited to the embodiments described above. Other embodiments and variations are within the scope of the present teachings.

For example, some embodiments provide a method for processing image data for displaying an image in a display window of a display unit. The display window may for example be the whole or part of the pixel area of display unit 110 of FIG. 3. For example, the display window may be the display area in which the new portion 1110 of FIG. 11 is to be displayed. The display may be a liquid crystal display (LCD), an organic light emitting display (OLED), or another type of display. Of note, the invention is not limited to displays using a backlight unit. For example, the SPR operation of FIG. 8 does not rely on a backlight unit.

The display unit comprises subpixels each of which is to emit one of a plurality of primary colors and to have a luminance depending on the subpixel's state defined using a subpixel value of the subpixel. The primary colors may be RGBW or may be some other colors. The subpixels may or may not be laid out as in FIG. 1. For example, in some embodiments, in each RG pair, the green pixel is to the left of the red pixel; in each BW pair, the white pixel is to the left. The subpixels may or may not be equal in area. For example, subpixels of one primary color may be larger than subpixels of another primary color. Subpixels of different primary colors may differ in number and/or density. In an LCD, the subpixel's state is defined by the subpixel's arrangement of the liquid crystal molecules which in turn is defined by the subpixel's voltage. In an OLED, the subpixel's state is defined by the subpixel current or other electrical parameters. The state is defined depending on the type of display.

Figure 2:
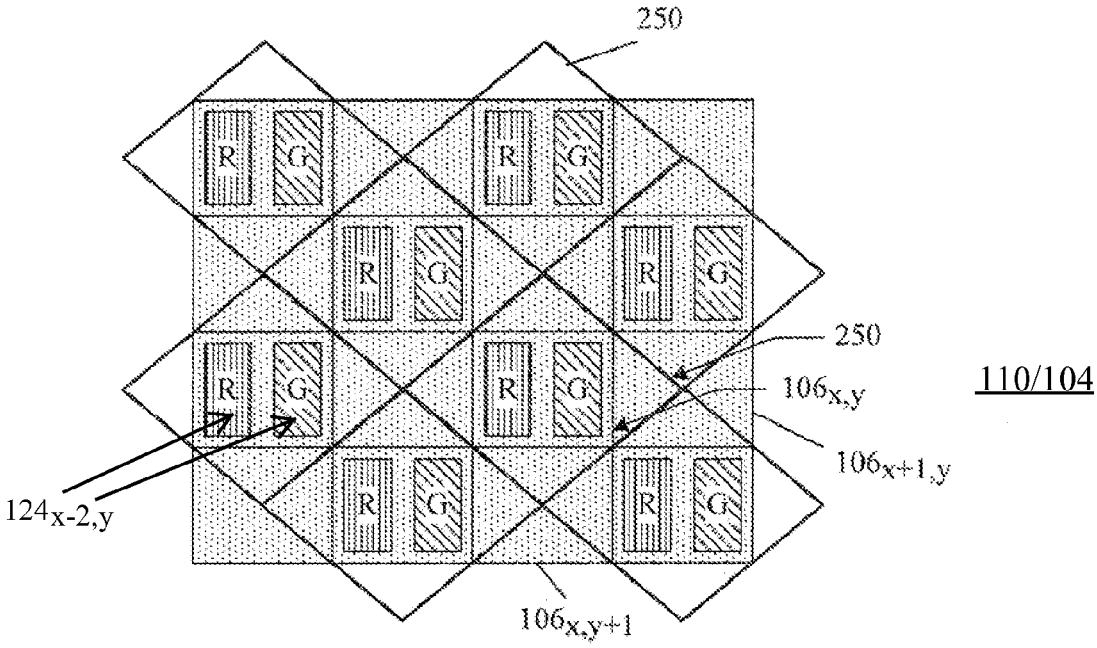
FIG. 2 PRIOR ART
FIG. 2 is a geometric illustration of a subpixel rendering operation according to prior art.

The method comprises: (1) obtaining, by a circuit (e.g. circuit 320), pixel data (e.g. RGBW data obtained in block 420) which represent, for each pixel, the pixel's color in coordinates (e.g. RGBW) associated with the primary colors. The invention is not limited to RGBW however. The method further comprises: (2) performing, by the circuit (e.g. by block 454 of circuit 320), a subpixel rendering (SPR) operation to provide a subpixel value for each subpixel in a set of one or more subpixels of the display window, the subpixel value being used in defining the respective subpixel's state in displaying the image. For example, the SPR operation may provide a subpixel value for each subpixel in a display area corresponding to the new portion 1110 (FIG. 11) except for the blue subpixels at the left edge. The SPR operation comprises, for at least one pixel PX1 and for at least two subpixels which are for emitting a primary color PC1, the following operations. For example, the pixel PX1 may be in FIG. 2, the one that corresponds to BW pair 124(x−1),y. However, in this text section that pixel PX1 will be re-identified as being a pixel $\mathbf{106}_{x,y}$ mapped into a respective BW pair 124.sub.x,y, and the two adjacent subpixels may be similarly identified as the red subpixels in the adjacent RG pairs $\mathbf{124}_{x-1,y}$, $\mathbf{124}_{x+1,y}$. One operation is an operation (2A) of testing the pixel data to determine if the pixel PX1 and/or one or more of its adjacent pixels satisfy a predefined first test. The first test may be, for example, the test consisting of steps 810 and 830 (FIG. 8) performed on pixels $\mathbf{106}_{x-1,y}$ and $\mathbf{106}_{x+1,y}$.

The SPR operation further comprises an operation (2B) of determining the subpixel values for the two subpixels of the primary color PC1. The operation (2B) is performed so that: (2B.1) if the first test fails (e.g. one or both of tests 810, 830 fail on each of pixels $\mathbf{106}_{x-1,y}$, $\mathbf{106}_{x+1,y}$), then in the SPR operation, the primary color PC1's coordinate of the pixel PX1 contributes to the subpixel values of the two subpixels with equal non-zero weights. For example, when step 820 or 840 is performed on each of the red subpixels in pairs $\mathbf{124}_{x-1,y}$, $\mathbf{124}_{x+1,y}$, and the diamond filter (1) is applied, the R coordinate of pixel $\mathbf{106}_{x,y}$ contributes to the Rw value of each of the red subpixels with the weight of ⅛.

The SPR operation is performed so that: (2B.2) if the first test passes (e.g. if the tests 810, 830 pass on at least one of subpixels $\mathbf{106}_{x-1,y}$, $\mathbf{106}_{x+1,y}$), then in the SPR operation, the primary color PC1's coordinate of the pixel PX1 contributes to the subpixel values of the two subpixels with different weights. For example, if the test 810 or 830 fails on pixel $\mathbf{106}_{x-1,y}$, then the box filter is applied at step 850, and the R coordinate of the pixel $\mathbf{106}_{x,y}$ contributes with a weight of ½ to the subpixel value of the red subpixel in pair $\mathbf{124}_{x-1,y}$. However, for the red subpixel in pair $\mathbf{124}_{x+1,y}$, the R coordinate of pixel $\mathbf{106}_{x,y}$ contributes with a weight of zero (at step 850) or ⅛ (at step 820 or 840).

In some embodiments, in the SPR operation, each pixel (e.g. 106) is associated with a display unit's area (e.g. 124) in which the pixel is to be displayed. The area associated with the pixel PX1 does not contain an entire subpixel of the primary color PC1. For example, the area $\mathbf{124}_{x,y}$ may be a BW area, and thus without a red subpixel.

In some embodiments, the display unit's area associated with the pixel PX1 does not contain any portion of a subpixel of the primary color PC1.

In some embodiments, the two subpixels are located on opposite sides of the display unit's area associated with the pixel PX1.

In some embodiments, the first test comprises: (i) a test that at least one of the colors of one or more of the pixel PX1 and the one or more adjacent pixels is a saturated color, wherein a saturated color is defined by a saturation parameter (e.g. such as described above in connection equation (8)) being in a predefined range (the range may consist of a single number, i.e. the upper and lower bounds may or may not be different); and (ii) a test that one or more of the pixel PX1 and the one or more adjacent pixels belong, or is adjacent, to a feature defined by at least one of one or more predefined patterns. Examples are patterns D1-D15.

In some embodiments, each said pattern comprises one or more first pixels and one or more second pixels. For example, in patterns D1-D15, the first pixels may correspond to the 1 values and the second pixels to the 0 values. If the image contains the pattern then the one or more first pixels' associated areas do not contain a subpixel of a primary color present in at least one second pixel's associated area. For example, each pattern D1-D15 contains either only one value of 1 or multiple such values on a diagonal. Therefore, the associated pairs of the 1-value pixels are all RG or all BW, and hence contain a color not present in the pair associated with at least one 0-value pixel.

Some embodiments provide a method for processing image data for displaying an image in a display window. The method comprises: (1) obtaining, by a circuit (e.g. 320), pixel data (e.g. RGBW data obtained in block 420 of FIG. 4 or 6) which represent, for each pixel, the pixel's color in coordinates (e.g. RGBW) associated with the primary colors. The method further comprises: (2) performing, by the circuit (e.g. by block 454 of circuit 320), a subpixel rendering (SPR) operation to provide a subpixel value for each subpixel in a set of one or more subpixels of the display window, the subpixel value being used in defining the respective subpixel's state in displaying the image, the SPR operation associating each pixel with a display unit's area (e.g. an area of the corresponding RG or BW pair) in which the pixel is to be displayed, wherein at least one area does not have an entire subpixel of at least one primary color (e.g. the RG area does not have a blue subpixel). The SPR operation comprises, for at least one pixel PX1 and for at least one subpixel SP1 which is for emitting a primary color PC1 in the area associated with the pixel PX1, the following operations. One operation is an operation (2A) of testing the pixel data to determine if the pixel PX1 and/or one or more of its adjacent pixels satisfy a predefined first test on the colors of the pixel PX1 and its adjacent pixels. The first test may be, for example, the test consisting of steps 810 and 830 in FIG. 8. The SPR operation further comprises an operation (2B) of determining the subpixel value for the subpixel SP1 using the primary color PC1's coordinate of one or more pixels. For example, if the subpixel SP1 is mapped in an RG pair, and PC1 is the green color, then the subpixel value for the subpixel SP1 is determined using the green coordinates G of one or more pixels. Further, the following holds: (2B.1) if the first test fails (e.g. either one or both of 810, 830 fail in FIG. 8), then in the SPR operation, the primary color PC1's coordinates of two pixels in a predefined position relative to the pixel PX1 contribute to the subpixel value of the subpixel SP1 with equal non-zero weights. For example, if pixel PX1 is pixel $\mathbf{106}_{x,y}$ mapped into an RG pair, the relative position can be the position on the left and right of pixel PX1. If pixel PX1 is mapped into a BW pair, then the relative position is on the left and right of the pixel $\mathbf{106}_{x-1,y}$ if the primary color PC1 is blue and a blue shift to the left is performed. Steps 820 and 840 use a diamond filter (1), (2) in which the coordinates of the adjacent pixels on the left and the right contribute with equal weights of ⅛.

Further: (2B.2) if the first test passes, then in the SPR operation, the primary color PC1's coordinates of said two pixels in the predefined position relative to the pixel PX1 contribute to the subpixel value of the subpixel SP1 with different weights. For example, in FIG. 8, step 850 uses box filter (7) in which one of the weights is 0 and the other one of the weights is ½. In the embodiment of Table 1, if the pixel is mapped into an RG pair, then the pixel on the left contributes with the zero weight (i.e. does not contribute), and the pixel on the right contributes with the ½ weight. If the pixel is mapped in a BW pair, then the box filter is applied to the RG pixel on the left to obtain the B and W subpixel values. Therefore, the RG pixel on the left of the BW pixel contributes with the ½ weight. The RG pixel on the right of the BW pixel does not contribute at all (i.e. contributes with the zero weight).

In some embodiments, the display unit's areas associated with the two pixels do not include a subpixel of the primary color PC1. For example, if a pixel $\mathbf{106}_{x,y}$ is mapped into an RG pair, and the primary color PC1 is red, then the areas of pairs $\mathbf{124}_{x-1,y}$ and $\mathbf{124}_{x+1,y}$ do not have a red subpixel.

In some embodiments, the first test comprises a test (i) that at least one of the colors of the pixel PX1 and of the adjacent pixels whose associated areas do not have a subpixel of the color PC1 is a saturated color (e.g. as in step 810; the saturated colors are performed only on the pairs above, below, to the left and to the right of the pixel using the Ortho filter, so they do not have the color PC1 of the pair whose subpixel values are being computed). A saturated color is defined by a saturation parameter (e.g. sin v in (8)) being in a predefined range (e.g. the one-value range of [1,1], or the infinite range of all numbers greater than or equal to 1, or the range of all the positive numbers), wherein the adjacent pixels comprise said pixels on said two opposite sides of the pixel PX1 (e.g. on the right and left sides). In some embodiments, the first test also comprises a test (ii) that the pixel PX1 belongs, or is adjacent, to a feature defined by at least one of one or more predefined patterns. Examples are patterns D1-D15.

In some embodiments, each said pattern comprises one or more first pixels and one or more second pixels. For example, in the patterns D1-D15, the first pixels may correspond to the 1 values and the second pixels to the 0 values. If the image contains the pattern then the one or more first pixels' associated areas do not contain a subpixel of a primary color present in at least one second pixel's associated area. For example, each pattern D1-D15 contains either only one 1 value or multiple 1 values on a diagonal. Therefore, the associated pairs of the 1-value pixels are all RG or all BW, and hence contain a color not present in the pair associated with at least one 0-value pixel.

In some embodiments, the test (ii) passes if in a color plane of each of one or more selected primary colors at least one of which is not a sum of any other primary colors: the primary color's coordinate of each first pixel is above a predefined threshold (e.g. BOBits in Table 1 lines D39-D41) while the primary color's coordinate of each second pixel is at or below the predefined threshold, and/or the primary color's coordinate of each second pixel is above a predefined threshold while the primary color's coordinate of each first pixel is at or below the predefined threshold.

Circuits are provided for performing the methods described herein. Other operations (e.g. gamma conversion and image display) are performed as needed.

Addendum A: Meta Luma Sharpening

In some embodiments, the meta luma sharpening for a pixel $\mathbf{106}_{x,y}$ is performed as follows. The pixel's RGBW coordinates are determined according to equations (3). Also, values L representing the luminances of pixel $\mathbf{106}_{x,y}$ and adjacent pixels are computed in some way, for example:

$$L=(2R+5G+B+8W)/16 \quad \text{(A1)}$$

Then if pixel $106_{x,y}$ is mapped into a BW pair, then the following filter is applied to the luminance L to produce a value a:

$$MLS_{BW} = \begin{pmatrix} 0 & -z/4 & 0 \\ -z/4 & z & -z/4 \\ 0 & -z/4 & 0 \end{pmatrix}$$

where z is some positive constant, e.g. ½. In other words, $$a=z*L_{x,y}-z/4*(L_{x-1,y}+L_{x+1,y}+L_{x,y-1}+L_{x,y+1}),$$

where $L_{i,j}$ is the luminance (A1) of pixel $106_{i,j}$. If pixel $106_{x,y}$ is mapped into an RG pair, then the value a is set to the output of the following filter applied to the L values:

$$MLS_{RG} = \begin{pmatrix} 0 & z/4 & 0 \\ z/4 & -z & z/4 \\ 0 & z/4 & 0 \end{pmatrix}$$

where z is some positive constant, e.g. ½. The z values may or may not be the same in the two filters. Then the value a is used to select a metamer for the pixel $106_{x,y}$ by modifying the RGBW coordinates as follows:

$$W=W+a$$

$$R=R-mr*a$$

$$G=G-mg*a$$

$$B=B-mb*a \quad \text{(A2)}$$

where mr, mg, mb are constants defined by the luminance emission properties of display 110 in such a way that the new RGBW values (i.e. the values on the left in equations (A2)) and the old values define the same color (i.e. are metamers). In some embodiments, mr=mg=mb=1. Additionally, the new RGWB values can be hard-clamped to the range of 0 to MAXCOL/$M_0$ for R, G, and B, and to MAXCOL/$M_1$ for W.

Addendum B: Determining Backlight Unit Output Power

Let us assume that RwGwBwWw are the subpixel values determined by the SPR block 454 of FIG. 6. These subpixel values are in the range of 0 to MAXCOL/$M_0$. As stated above, these subpixel values correspond to the BL value $BL_0$. In block 430, the output power BL can be chosen by choosing the maximum subpixel value P which is to be displayed without distortion. More particularly, as indicated above, $$BL=BL_0/INVy$$

If the subpixel value P is the maximum value to be displayed without distortion, then $$P*INVy=\text{MAXCOL, and therefore}$$

$$INVy=\text{MAXCOL}/P\text{, i.e.}$$

$$BL=BL(P)=BL_0*P/\text{MAXCOL} \quad \text{(B1)}$$

There are a number of ways to select P. In some embodiments, the Rw, Gw, Bw, Ww subpixel values generated by the SPR block 454 are multiplied by respective coefficients Rweight, Gweight, Bweight, Wweight (e.g. Rweight=84%, Gweight=75%, Bweight=65% or 75%, and Wweight=100%), and P is selected as the maximum, over the whole image, of the resulting values, i.e.

$$P=\max(Rw*R\text{weight},Gw*G\text{weight},Bw*B\text{weight},Ww*W\text{weight}) \quad \text{(B1-A)}$$

In some embodiments, the coefficient Rweight is replaced by a variable coefficient Xweight computed as follows:

$$X\text{weight}=R\text{weight}+((Y\text{weight}-R\text{weight})*Gw/2^{SBITS}) \quad \text{(B1-B)}$$

wherein Rweight, Yweight, and SBITS are predefined constants.

The subpixel value P can be chosen in other ways to obtain a desired image quality.

In other embodiments, the BL value is computed as follows. First, for each subpixel 120, a value $P_{sub}$ is computed as in (B1-A) or (B1-B), i.e. the maximum in (B1-A) is taken over the Rw, Gw, Bw, Ww values for the subpixel and not over all the subpixels in the image. Then a BL value BL=BL($P_{sub}$) is initially computed in accordance with (B1) for each subpixel value 120 (with $P_{sub}$ replacing P). These initial BL values are accumulated into a histogram. The histogram's bins (counters) are traversed backwards (starting with the highest BL value), and an accumulate-error function E_sum is computed which is the sum of the BL values in the bins traversed. For example E_sum[i] can be the sum of the BL values in bins with bin numbers greater than or equal to i, where the index i increases with BL (i.e. higher BL values are placed in bins with higher i). The traversal stops when E_sum[i] reaches or exceeds a predefined threshold TH1. Suppose this happens at bin i=i0. In some embodiments, the backlight output power BL is set to some value in bin i0. For example, if each bin i counts the BL values between some numbers $b_i$ and $b_{i+1}$ (all BL with $b_i \leqq BL < b_{i+1}$), then the output power BL can be set to $b_{i0}$ or some other value at least $b_{i0}$ and less than $b_{i0+1}$.

In some embodiments, linear interpolation is performed to select the BL value in bin i0. For example, the output power BL can be defined as the sum:

$$BL=b_{i0}+\text{fine_adjust_offset} \quad \text{(B2)}$$

where $$\text{fine_adjust_offset}=(\text{Excess}/\text{Delta_}E\text{_sum}[i0])*\text{bin_size} \quad \text{(B3)}$$

where Excess=E_sum[i0]−TH1; Delta_E_sum[i0]=E_sum[i0]−E_sum[i0+1], where bin_size is the size of each bin, i.e. bin_size=$b_{i+1}-b_i$ (this value is 16 in some embodiments).

An additional adjustment can be made by comparing Excess to another, upper threshold TH2. If Excess>TH2, then fine_adjust_offset can be set to:

$$\text{fine_adjust_offset}=(\text{Excess}/TH2)*\text{bin_size}$$

and then (B2) can be used to determine BL. These embodiments are not limiting.

In some embodiments, the BL and INVy values lag the RwGwBwWw data by one frame. More particularly, the INVy value determined from the RwGwBwWw data for one frame ("current frame") is used by scaler 444 for scaling the next frame. The BL value determined from the RwGwBwWw data for the current frame is used to control backlight unit 310 when LCD panel 110 displays the next frame. The current frame is scaled and displayed using the BL and INVy values determined from the previous frame of data. This lag allows one to start displaying the current frame before the current-frame BL and INVy values have been determined. In fact, displaying the current frame may begin even before all the sRGB data for the current frame have been received. To reduce image errors, the BL value can be "decayed", i.e. the BL value can be generated by block 430 as a weighted average of the BL value determined from the data for the current frame and the previous BL value. In some displays which display 30 frames per second, when the image brightness abruptly changes, it may take about 36 frames for the BL and INVy values to catch up with the image brightness. This delay is acceptable in many applications. Indeed, in the absence of abrupt changes of the image brightness, the BL and INVy values typically do not change much from frame to frame, and a one-frame lag does not cause significant degradation of the image. When abrupt changes of brightness do occur, it takes time for the viewer to visually adjust to the image, so image errors due to the lag of the BL and INVy values do not stand out. See also U.S. patent application published as US 2009/0102783 A1 on Apr. 23, 2009, filed by Hwang et al., incorporated herein by reference.

The invention claimed is:

1. A method for processing image data for displaying an image in a display window of a display unit comprising some subpixels each of which is to emit just one of a plurality of primary colors and other subpixels each of which is to emit a white light where the subpixels are to each have a luminance depending on the subpixel's state defined using a supplied subpixel value for the respective subpixel, the method comprising:

(1) obtaining, by a circuit, pixel data which represent, for each pixel, the pixel's color as mapped into coordinates associated with the primary colors;

(2) performing, by the circuit, a subpixel rendering (SPR) operation to provide a respective subpixel value for each respective subpixel in a predefined set of three or more subpixels of the display window, the respective subpixel values being used in defining the respective subpixel's state in displaying the image;

wherein the SPR operation comprises, for at least one pixel PX1 in the predefined set and for at least two subpixels also in the predefined set and which are each configured for emitting a primary color PC1:

(2A) testing the pixel data to determine if the pixel PX1 and/or one or more of its adjacent pixels satisfy a predefined first test; and (2B) determining the subpixel values for the two subpixels of the primary color PC1, wherein:

(2B.1) if the first test fails, then in the SPR operation, the primary color PC1's coordinate of the pixel PX1 contributes to the subpixel values of the two subpixels with equal non-zero weights;

(2B.2) if the first test passes, then in the SPR operation, the primary color PCPs coordinate of the pixel PX1 contributes to the subpixel values of the two subpixels with different weights.

2. The method of claim 1 wherein in (2B.2), one of the different weights is zero.

3. The method of claim 1 wherein in the SPR operation, each pixel is associated with a display unit's area in which the pixel is to be displayed; wherein the display unit's area associated with the pixel PX1 does not contain an entire subpixel of the primary color PC1.

4. The method of claim 3 wherein the display unit's area associated with the pixel PX1 does not contain any portion of a subpixel of the primary color PC1.

5. The method of claim 3 wherein the two subpixels are located on opposite sides of the display unit's area associated with the pixel PX1.

6. The method of claim 1 wherein the first test comprises: (i) a test that at least one of the colors of one or more of the pixel PX1 and the one or more adjacent pixels is a saturated color, wherein a saturated color is defined by a saturation parameter being in a predefined range; and (ii) a test that one or more of the pixel PX1 and the one or more adjacent pixels belong, or is adjacent, to a feature defined by at least one of one or more predefined patterns.

7. The method of claim 6 wherein in the SPR operation, each pixel is associated with a display unit's area in which the pixel is to be displayed; and each said pattern comprises one or more first pixels and one or more second pixels such that the one or more first pixels' associated areas do not contain a subpixel of a primary color present in at least one second pixel's associated area.

8. The method of claim 7 wherein the test (ii) passes for at least one of the pixel PX1 and the one or more adjacent pixels if in a color plane of each of one or more of selected primary colors at least one of which is not a sum of any other primary colors: the primary color's coordinate of each first pixel is above a predefined threshold while the primary color's coordinate of each second pixel is at or below the predefined threshold, and/or the primary color's coordinate of each second pixel is above a predefined threshold while the primary color's coordinate of each first pixel is at or below the predefined threshold.

9. The method of claim 1 further displaying the image by using the subpixel values.

10. The method of claim 1 wherein the pixel PX1 is one of a plurality of pixels PX of the image, and the primary color PC1 is one of a plurality of primary colors PC, and the operation (2) is performed for each said pixel PX and associated two subpixels of an associated primary color PC, wherein for at least one said pixel PX the first test passes, and for at least one said pixel PX the first test fails.

11. The method of claim 1 wherein the image is one of a plurality of images displayed by the display unit, the pixel PX1 is one of a plurality of pixels PX of the images, and the primary color PC1 is one of a plurality of primary colors PC, wherein the operation (2) is performed for each said image and for each said pixel PX and associated two subpixels of an associated primary color PC, wherein for at least one image and at least one said pixel PX the first test passes, and for at least one image and at least one said pixel PX the first test fails.

12. The method of claim 1, wherein the primary color PC1 is red, green or blue.

13. A method for processing image data for displaying an image in a display window of a display unit comprising subpixels each of which is to emit one of a plurality of primary colors and to have a luminance depending on the subpixel's state, the method comprising: (1) obtaining, by a circuit, pixel data which represent, for each pixel, the pixel's color in coordinates associated with the primary colors; (2) performing, by the circuit, a subpixel rendering (SPR) operation to provide a subpixel value for each subpixel in a set of one or more subpixels of the display window, the subpixel value being used in defining the respective subpixel's state in displaying the image, the SPR operation associating each pixel with a display unit's area in which the pixel is to be displayed, wherein at least one area does not have an entire subpixel for at least one primary color; wherein the SPR operation comprises, for at least one pixel PX1 and for at least one subpixel SP1 which is for emitting a primary color PC1 in the area associated with the pixel PX1: (2A) testing the pixel data to determine if the pixel PX1 and/or one or more of its adjacent pixels satisfy a predefined first test on the colors of the pixel PX1 and its adjacent pixels; (2B) determining the subpixel value for the subpixel SP1 using the primary color PC1's coordinates of one or more pixels, wherein: (2B.1) if the first test fails, then in the SPR operation, the primary color PC1's coordinates of two pixels in a predefined position relative to the pixel PX1 contribute to the subpixel value of the subpixel SP1 with equal non-zero weights; (2B.2) if the first test passes, then in the SPR operation, the primary color PC1's coordinates of said two pixels in the predefined position relative to the pixel PX1 contribute to the subpixel value of the subpixel SP1 with different weights.

14. The method of claim 13 wherein the two pixels in the predefined position are on opposite sides of the pixel PX1.

15. The method of claim 13 wherein the two pixels in the predefined position comprise the pixel PX1.

16. The method of claim 13 wherein in the SPR operation, each subpixel is associated with a sampling area containing the subpixel, and the two pixels in the predefined position are on opposite sides of the sampling area associated with the subpixel PX1.

17. The method of claim 13 wherein the display unit's areas associated with the two pixels do not include a subpixel of the primary color PC1.

18. The method of claim 17 wherein the first test comprises: (i) a test that at least one of the colors of the pixel PX1 and of the adjacent pixels whose associated areas do not have a subpixel of the color PC1 is a saturated color, wherein a saturated color is defined by a saturation parameter being in a predefined range, wherein the adjacent pixels comprise said pixels on said two opposite sides of the pixel PX1; and (ii) a test that the pixel PX1 belongs, or is adjacent, to a feature defined by at least one of one or more predefined patterns.

19. The method of claim 18 wherein each said pattern comprises one or more first pixels and one or more second pixels such that the one or more first pixels' associated areas do not contain a subpixel of a primary color present in at least one second pixel's associated area.

20. The method of claim 19 wherein the test (ii) passes if in a color plane of each of one or more selected primary colors at least one of which is not a sum of any other primary colors: the primary color's coordinate of each first pixel is above a predefined threshold while the primary color's coordinate of each second pixel is at or below the predefined threshold, and/or the primary color's coordinate of each second pixel is above a predefined threshold while the primary color's coordinate of each first pixel is at or below the predefined threshold.

21. The method of claim 13 further comprising using the subpixel values to display the image.

22. The method of claim 13 wherein the pixel PX1 is one of a plurality of pixels PX of the image, the subpixel SP1 is one of a plurality of subpixels SP, and the primary color PC1 is one of a plurality of primary colors PC, and the operation (2) is performed for each said pixel PX and associated subpixel SP of an associated primary color PC, wherein for at least one said pixel PX the first test passes, and for at least one said pixel PX the first test fails.

23. The method of claim 13 wherein the image is one of a plurality of images displayed by the display unit, the pixel PX1 is one of a plurality of pixels PX of the images, the subpixel SP1 is one of a plurality of subpixels SP, and the primary color PC1 is one of a plurality of primary colors PC, wherein the operation (2) is performed for each said image and for each said pixel PX and an associated subpixel SP1 of an associated primary color PC, wherein for at least one image and at least one said pixel PX the first test passes, and for at least one image and at least one said pixel PX the first test fails.

24. The method of claim 13, wherein the primary color PC1 is red, green or blue.

25. A machine-implemented method that provides for retaining of chrominance contrast in an image displaying system that receives an input image signal representing input pixels (PX) of an image that is to be displayed in a display window of the image displaying system, where the image displaying system performs a subpixel rendering operation (SPR) on the input image signal;

where the image displaying system includes a display for displaying the image in a respective display window of the display and where the display has alternating luminance accentuation pair regions repeatedly disposed thereon, a first of the pair regions being a PC3-W pair region (PW pair region) and a second being a PC1-PC2 pair region (PP pair region), where PC1, PC2 and PC3 are respective and different, first, second and third primary colors that are substantially reproducible in saturated form by corresponding first, second and third primary-color-providing subpixels of the display, where W is an unsaturated and relatively white light output that is producible by corresponding fourth subpixels of the display, and where a boundary of a chromatically high contrast edge of an image object represented by the input image signal can map to a line on the display that includes the color-unsaturated W portions of the PW pair regions, the method comprising:

first performing by a machine circuit, and based on a mapping of respective ones of the input pixels (PX) of the input image signal to corresponding ones of the luminance accentuation pair regions (PW or PP) of the display window, a first test on the respective input pixels (PX) of the input image signal to determine for each tested input pixel ($PX_{xy}$) a corresponding first state of a corresponding local test zone composed of the tested input pixel ($PX_{xy}$) and a plurality of other adjacent input pixels where the local test zone not only has a predefined size and a predefined shape but also respectively associated chrominances to be output by its respective pixels in accordance with the input image signal, where the first test determines as the first state, whether or not at least one of the respective chrominance of the local test zone includes a substantially saturated chrominance;

in automatic response to the first test determining that at least one of the respective chrominances of the local test zone does not include a substantially saturated chrominance, using a first of pre-specified and different filtering and/or sharpening algorithms when performing said subpixel rendering operation (SPR) on the input image signal and otherwise using another of the pre-specified and different filtering and/or sharpening algorithms when performing said subpixel rendering operation (SPR).

26. The machine-implemented method of claim 25 wherein:

the first, second and third primary colors are red (PC1), green (PC2) and blue (PC3) respectively.

27. The machine-implemented method of claim 25 wherein:

the local test zone has the shape of two orthogonal lines.

28. The machine-implemented method of claim 27 wherein:

the local test zone extends just one pixel to the left and one pixel to the right of the tested input pixel ($PX_{xy}$).

29. The machine-implemented method of claim 28 wherein:

the local test zone extends just one pixel above and one pixel below the tested input pixel ($PX_{xy}$).

30. The machine-implemented method of claim 27 wherein:

the determining that at least one of the respective chrominance of the local test zone does not include a substantially saturated chrominance includes determining if the chrominance is within a predetermined range of chrominance intensities for at least one of the first, second and third primary colors.

31. The machine-implemented method of claim 27 and further comprising:

in automatic response to the first test determining that at least one of the respective chrominances of the local test zone does include a substantially saturated chrominance, second performing by a machine circuit, a second test on the respectively tested input pixel ($PX_{xy}$) to determine if the tested input pixel is mapped to a diagonal line on the display that includes the color-unsaturated W portions of the PW pair regions; and in automatic response to the second test determining that the tested input pixel is mapped to said diagonal line that includes the color-unsaturated W portions, using a second of pre-specified and different filtering and/or sharpening algorithms when performing said subpixel rendering operation (SPR) on the input image signal and otherwise using a third of the pre-specified and different filtering and/or sharpening algorithms when performing said subpixel rendering operation (SPR).

* * * * *